US005725318A

United States Patent [19]

Yamaguchi et al.

[11] Patent Number: 5,725,318

[45] Date of Patent: Mar. 10, 1998

[54] TAPE-SHAPED LABEL PRINTING DEVICE USABLE WITH RIBBON CASSETTES HAVING NEWLY ADDED COLORS

[75] Inventors: Koshiro Yamaguchi, Kasugai; Akihiko Niwa, Nagoya, both of Japan

[73] Assignee: Brother Kogyo Kabushiki Kaisha, Nagoya, Japan

[21] Appl. No.: 727,990

[22] Filed: Oct. 10, 1996

[30] Foreign Application Priority Data

Oct. 17, 1995 [JP] Japan ..... 7-268838

[51] Int. Cl.[6] ..... B41J 2/325

[52] U.S. Cl. ..... 400/120.02; 400/586; 400/615.2; 347/174

[58] Field of Search ..... 400/61, 70, 120.02, 400/120.04, 582, 580, 615.2; 347/172, 174

[56] References Cited

U.S. PATENT DOCUMENTS

| | | | |
|---|---|---|---|
| 5,018,080 | 5/1991 | Inoue | 364/519 |
| 5,108,209 | 4/1992 | Menzenski | 400/208 |
| 5,232,297 | 8/1993 | Kitazawa . | |
| 5,360,279 | 11/1994 | Asai et al. . | |
| 5,480,246 | 1/1996 | Morimoto | 400/615.2 |
| 5,609,424 | 3/1997 | Sakuragi et al. | 400/615.2 |

FOREIGN PATENT DOCUMENTS

| | | |
|---|---|---|
| 0 704 311 | 4/1996 | European Pat. Off. . |
| 5-84994 | 4/1993 | Japan . |
| 2 253 812 | 9/1992 | United Kingdom . |

OTHER PUBLICATIONS

Patent Abstracts Of Japan: (JP-A-60-201972) vol. 10, No. 51 (M-457) [2108], 28 Feb. 1986.

Patent Abstracts Of Japan: (JP-A-02-039985) vol. 14, No. 198 (M-965) [4141], 23 Apr. 1990.

Patent Abstracts of Japan: (JP-A-02-151472) vol. 14, No. 399 (M-1017) [4342], 29 Aug. 1990.

*Primary Examiner*—John S. Hilten

*Attorney, Agent, or Firm*—Oliff & Berridge, PLC

[57] ABSTRACT

1. A tape-shaped label printing device for use with a plurality of freely detachable ribbon cassettes each housing a different colored ink ribbon, the label printing device comprising: a keyboard for inputting text, such as characters and symbols, and for inputting a variety of commands; a data memory for storing inputted text data; a print mechanism including a print head for printing on a print tape in colors of the ink ribbons in the ribbon cassettes; an order setting unit for setting a printing order for printing text stored in the data memory means in a first plurality of colors using corresponding ones of the different colored ink ribbons; and a print control unit for driving the print means to print in the print order set by the order setting means.

19 Claims, 29 Drawing Sheets

| TEXT DATA | ORDER DATA |
|---|---|
| A | 1 |
| B | 1 |
| SP | |
| C | 2 |
| D | 2 |
| E | 2 |
| SP | |
| F | 3 |
| G | 3 |

121

| TEXT DATA | ORDER DATA |
|---|---|
| A | RED |
| B | RED |
| SP | |
| C | GREEN |
| D | GREEN |
| E | GREEN |
| SP | |
| F | BLACK |
| G | BLACK |

121

TAPE-SHAPED LABEL PRINTING DEVICE USABLE WITH RIBBON CASSETTES HAVING NEWLY ADDED COLORS

BACKGROUND OF THE INVENTION

1. Field of the Invention

The present invention relates to a device capable of multi-color printing by replacing a plurality of ribbon cassettes each having a different color of ribbon.

2. Description of the Related Art

Japanese Patent Application (Kokai) No. HEI-5-84994 describes a tape-shaped label printing device, which prints characters and marks, such as alphabetic characters and symbols, on a tape printing medium and is suitable for making labels to adhere to file tabs. This tape-shaped label printing device includes a keyboard, a display, and a printing mechanism of the thermal printing type, and is configured to print characters, marks, and the like in a variety of font styles and sizes on a printing tape medium of widths such as 6, 9, 12, 18, and 24 mm.

The tape-shaped labels printed with character arrays are not limited to use on file tabs. These labels are also appropriate for sticking on cassettes and their cases, or video tapes and their cases, for example. In such a case, multiple colored character arrays may be partially changed in accordance with recorded content and genre.

SUMMARY OF THE INVENTION

It is conceivable to produce a plurality of ribbon cassettes, separate from the tape cassette, with ink ribbons of not only black, but a plurality of colors such as red, green, and blue. Each of the ribbon cassettes is detachably mounted to the tape cassette. Also, to inputted text, a range of characters to be printed in each print color of a plurality of colors for multi-color printing is set. First, the range for printing with a black ribbon color is set. Next, the range for printing with a red ribbon color is set. Then, in the same manner, the range for printing in the remaining print colors are set. By successively replacing ribbon cassettes having the same ribbon color as the set print color, inputted print text can be printed in full color in a plurality of colors.

With this conceivable method of setting the print range for printing in various colors, it is easy for a user to be know what colors he or she has set and also it is easy for the user to perform settings. However, the number of ribbon colors of ribbon cassettes has increased due to consumer demand. With above-described method, print colors can be set for existing colors, but there is a problem that setting for newly added print colors can not be performed.

It is an objective of the present invention to overcome the above-described problems and to provide a tape-shaped label printing device wherein setting of existing print colors can be easily performed and moreover capable of setting print colors of newly added ribbon cassettes.

In order to achieve these objectives, a tape-shaped label printing device according to the present invention a tape-shaped label printing device for use with a plurality of freely detachable ribbon cassettes each housing a different colored ink ribbon, includes input means for inputting text, such as characters and symbols, and for inputting a variety of commands; data memory means for storing inputted text data; print means including a print head for printing on a print tape in colors of the ink ribbons in the ribbon cassettes; order setting means for setting a printing order for printing text stored in the data memory means in a first plurality of colors using corresponding ones of the different colored ink ribbons; and print control means for driving the print means to print in the print order set by the order setting means.

According to another aspect of the present invention, the order in which a print color or a plurality of print colors is printed is set to inputted text by either the order setting means or a color setting means, whichever is selected by a selection means. The print control means drives the print means according to the settings of the selected means so that printing is performed in a plurality of print colors.

According to a further aspect of the present invention, when the color setting means is selected by the selection means, a comparative command means compares print colors to be printed with the ribbon color detected by the ribbon color detection means. The print control means executes printing operations only when both colors match.

According to a still further aspect of the present invention, a first printing target setting means sets, from the text, characters and symbols of printing target for each print color other than a lastly set print color. A second printing target setting means automatically sets, as the printing target of the print color lastly set, those characters and symbols other than the characters and symbols set by the first printing target setting means.

According to still another aspect of the present invention, a third printing target setting means sets, from the text, those characters and symbols of printing targets for each order other than the lastly set order. The forth printing target setting means automatically sets, as the printing target of the order lastly set, those characters and symbols of the text other than those characters and symbols set by the third printing target setting means.

BRIEF DESCRIPTION OF THE DRAWINGS

The above and other objects, features and advantages of the invention will become more apparent from reading the following description of the preferred embodiment taken in connection with the accompanying drawings in which:

FIG. 27(*a*) is an explanatory diagram showing data configuration of order setting in a text memory;

FIG. 27(*b*) is an explanatory diagram showing the data configuration of color setting in the text memory;

FIG. 28(*b*) is an explanatory diagram showing a point at which the tape has been supplied by the length of the front margin;

FIG. 28(*c*) is an explanatory diagram showing the point at which the tape has been further supplied by a distance of idle feeding;

DETAILED DESCRIPTION OF THE PREFERRED EMBODIMENTS

Figure 1:
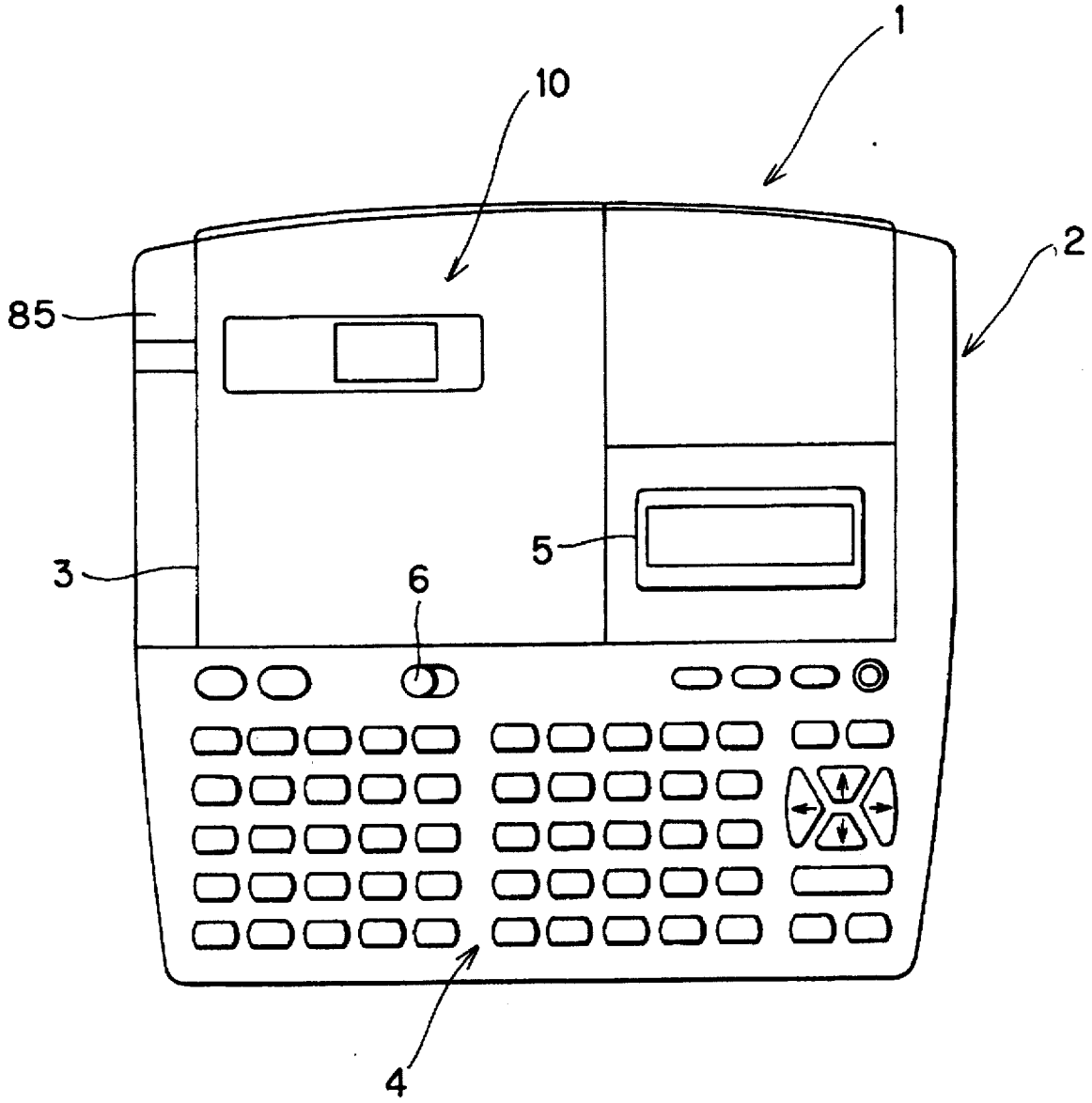
FIG. 1 is a plan view showing a tape-shaped label printing device according to an embodiment of the present invention.

A tape-shaped label printing device according to a preferred embodiment of the present invention will be described while referring to the accompanying drawings wherein like parts and components are designated by the same reference numerals to avoid duplicating description.

The present embodiment is applied to a tape-shaped label printing device capable of printing characters, symbols, and the like in a plurality of colors on a printing tape, which is a printing medium, by exchanging a plurality of ribbon cassettes, each with a different ribbon color.

As shown in FIG. 1, a keyboard 4 is arranged on the front portion of the main cover 2 of a tape-shaped label printing device 1. The keyboard 4 is provided with various function keys and includes keys such as character keys, symbol keys, and numeric keys. Immediately behind the keyboard 4, a liquid crystal display 5 capable of displaying the input characters, symbols, and the like is provided. A thermal printing mechanism 10 containing a thermal head 12 is provided within the main cover 2. The thermal head 12 is provided at a position corresponding to a cassette cover 3, which is opened and closed to allow exchanging of ribbon cassettes 30. A slide knob 6 is provided slidably for opening the cassette cover 3. A cutting knob 85 is also provided, which is pressed down for manually cutting a printing tape 22 which has been printed on.

Next, the thermal printing mechanism 10 including the thermal head 12 will be described with reference to FIGS. 2 through 8.

First, a tape cassette 20 detachably mounted on the thermal printing mechanism 10 will be described with reference to FIGS. 2 through 5 and FIG. 7.

A tape spool 23 is rotatably provided on the inside of a tape case 21 of the tape cassette 20. Around the tape spool 23 is wound a printing tape 22 formed of a thin film. The printing tape 22 supplied from the tape spool 23 is moved in the tape feeding direction by a tape feeding roller 24 while being guided in a curved passage by a plurality of guides, passing directly in front of the thermal head 12, and discharged out of the tape cassette 20.

Figure 7:
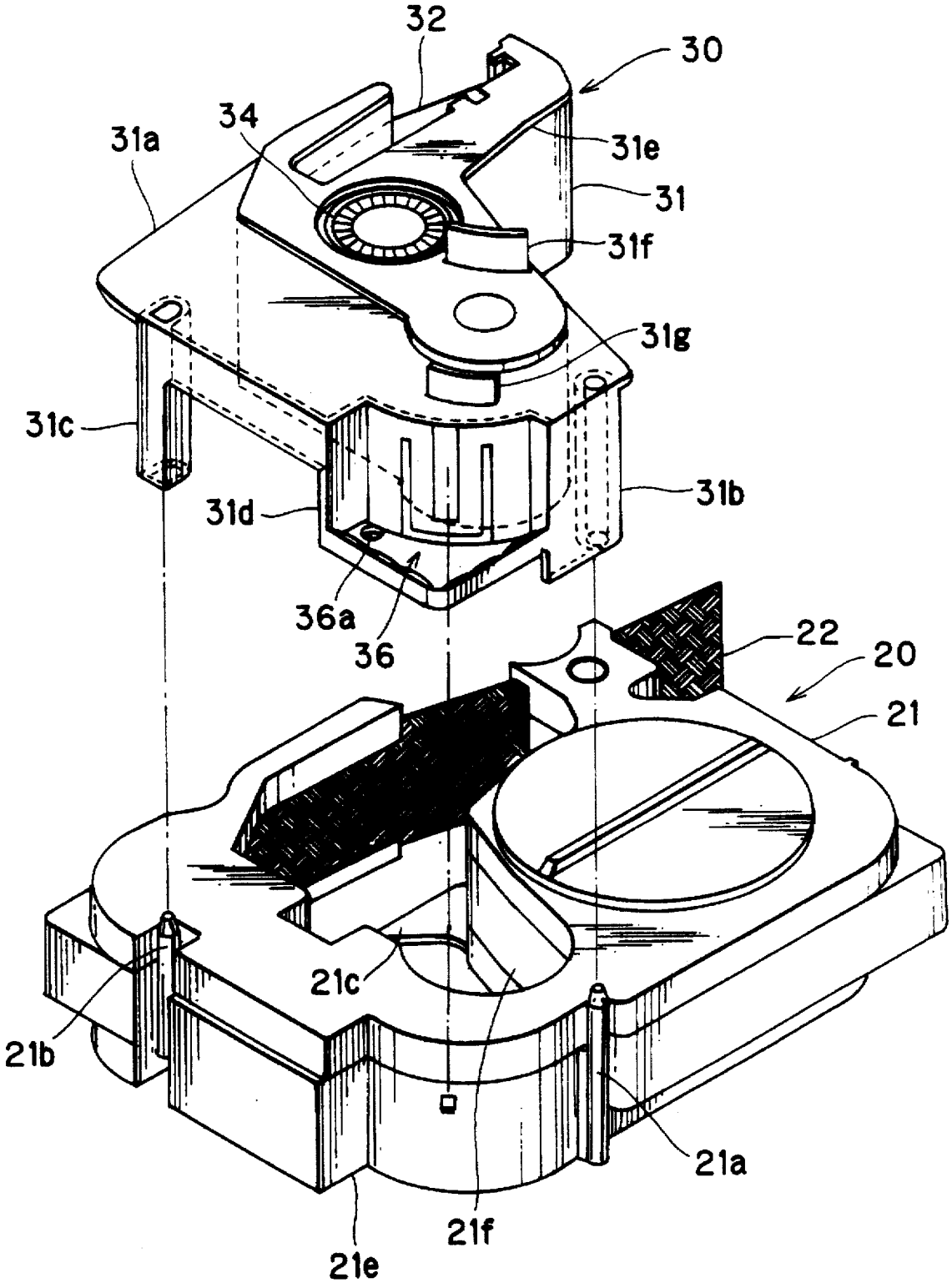
FIG. 7 is a rear perspective view showing the ribbon cassette before it is loaded into the tape cassette.

As shown in FIG. 7, a pair of guide shafts 21*a* and 21*b* are provided at positions spaced away from each other for supporting the ribbon cassette 30. Each lower end portion of the guide shafts 21*a*, 21*b* is provided integrally with an outer peripheral wall of the tape cassette 20. The ribbon cassette 30 is slidably movable in a vertical direction along the guide shafts and is supported thereby for exchanging the ribbon cassette 30 with a new ribbon cassette. Further, a pair of lower end walls 21*c* and 21*d* are formed on the tape case 21 for supporting the lower surface of the ribbon cassette 30.

Next, the ribbon cassette 30, which is removably mounted on the tape cassette 20, will be described with reference to FIGS. 2 through 8.

The ribbon cassette 30 includes a ribbon case 31 which is integrally provided with an upper wall 31*a* extending horizontally and adapted to contact with the top wall of the tape case 21. A pair of engaging feet 31*b* and 31*c*, each having a through-hole running through its entire length, extend integrally from the lower surface of the upper wall 31*a* and at edge portions thereof to fit around the pair of guide shafts 21*a* and 21*b* of the tape case 21. A vertical wall 31*d* is integrally suspended from the upper wall 31*a*. The vertical wall 31*d* is in contact with a notch 21*e* on the tape case 21. A head accommodating portion 37 is formed on the ribbon cassette 30 to accommodate the thermal head 12, which is inserted from below and passed through the tape cassette 20.

In addition, the inner portion of the ribbon case 31 is rotatably provided with a ribbon spool 33 around which the ink ribbon 32 is wound, and a take-up spool 34 for taking up the ink ribbon 32. Through an ink ribbon passage provided in the ribbon cartridge 30, the ink ribbon 32 winding over the ribbon spool 33 extends in parallel with and in the vicinity of the printing tape 22 when the ink ribbon 32 is placed against the thermal head 12, and the ink ribbon is bent in an approximate acute angle at the separation portion 35*a* of a separation member 35 provided integrally with the ribbon case 31. Thus the ink ribbon 32 is separated from the printing tape 22 and taken up by the ribbon take-up spool 34. The separation member 35 of the ribbon case 31 is positioned on the downstream side of the thermal head 12 in the tape feeding direction. A lid 31*e* is provided on the ribbon case 31 to support from above parts such as the ribbon spool 33, the take-up spool 34, and the separation member 35, etc.

A ribbon cassette accommodating portion 21*f* for accommodating the ribbon cassette 30 is formed in the tape case 21 as shown in FIG. 7. Tabs 31*f* and 31*g* are provided on the upper surface of the lid 31*e* and upper wall 31*a* of the ribbon case 31, respectively. When printing, the tape case 21 is first mounted in a recessed portion (not shown) formed in the main cover 2, and then, the ribbon cassette 30 having the desired color of ink ribbon 32 can be mounted in the ribbon cassette accommodating portion 21*f* of the tape case 21. In mounting the ribbon cassette 30 in the ribbon cassette accommodating portion 21*f*, while grasping each of the tabs 31*f* and 31*g* with two fingers, the engaging legs 31*b* and 31*c* are fitted around their corresponding guide shafts 21*a* and 21*b* via the holes running through the engaging legs 31*b* and 31*c*, and the ribbon cassette 30 is moved downward so that it is received in the ribbon cassette accommodating portion 21*f*. At this time, the upper wall 31*a* of the ribbon case 31 is resting on the top surface of the tape cassette 20, while the lower end of the ribbon cassette 30 is brought into abutment with the pair of lower end walls 21*c* and 21*d* of the tape case 21 from above, and the ribbon cassette 30 is held in a desirable position relative to the tape case 21.

With colors such as red, green, yellow, and black and ribbon widths such as 12, 18, 24, and 32mm, a plurality of varieties of ink ribbons 32 have been prepared for the ribbon cassette 30. A group of detection holes 36 made up of a maximum of six detection holes 36*a* (the ribbon cassette of FIG. 6 only shows one detection hole 36*a*) is formed on a lower horizontal end portion of the vertical wall 31*d* on the ribbon case 31 for allowing detection of any one of these plurality of varieties of ribbon cassettes 30.

Next, a tape/ribbon transfer mechanism 40 will be described with reference to FIG. 9. The tape/ribbon transfer mechanism 40 can move the printing tape 22 and the ink ribbon 32 in the feeding direction, i.e., the printing direction, and in the rewinding direction, i.e., the direction opposite to the printing direction.

Supported rotatably on the main frame 11 are a tape take-up cam 41 engageable with the center portion of the tape spool 23, a ribbon take-up cam 42 engageable with the center portion of the ribbon take-up spool 34, and a tape drive cam 43 engageable with the center portion of the tape feed roller 24. The main frame 11 is provided with the thermal head 12, and also with a group of ribbon detection switches 103, including detection switches No. 1 through No. 6, for detecting the existence of the six detection holes 36*a* in the previously mentioned group of detection holes 36. The ribbon detection signal RS is output according to the combination of switch signals from these six detection switches. The cassette detection means is thus constructed by the group of ribbon detection switches 103 and the group of detection holes 36.

Further, a tape drive motor 44 such as a stepper motor is installed on the right front end portion of the main frame 11. Gears 46 through 53, each rotatably supported on the main frame 11 are interlocked sequentially with a drive Gear 45 of the tape drive motor 44. A gear 55 and a tape drive gear 54 coupled to the tape drive cam 43 are meshedly engaged with the gear 53. Among these gears, gears 48 and 49 are provided integrally and are fixed to the lower end portion of the ribbon take-up cam 42. Gears 50 and 51 are provided integrally. Additionally, tape take-up gear 52 is fixed to the lower end portion of the tape take-up cam 41. Thus, the rotation of the tape drive motor 44 is transmitted to the tape drive cam 43 fixed to the tape drive gear 54 via the gears 45 through 54. Accordingly, the printing tape 22 is moved by the rotation of the tape feed roller 24.

A swing lever 56 is provided. The swing lever 56 has a base portion supported in a space between the gears 50 and 51 integral therewith. An appropriate amount of frictional resistance is provided between the swing lever 56 and the two gears. The swing lever 56 is rotatably provided with a planet gear 57 continuously engaged with the gear 51. The gear 53 has a rotation shaft 58 to which a base end portion of a cut-restricting lever 84 is urgedly supported. That is, the cut-restricting lever 84 supports thereon a torsion spring 59, and one end of the torsion spring and the base end of the lever 84 interpose therebetween the shaft 58, so that the base end of the cut restricting lever 84 is urgedly pressed against the shaft 58 by the biasing force of the torsion spring 59.

Figure 9:
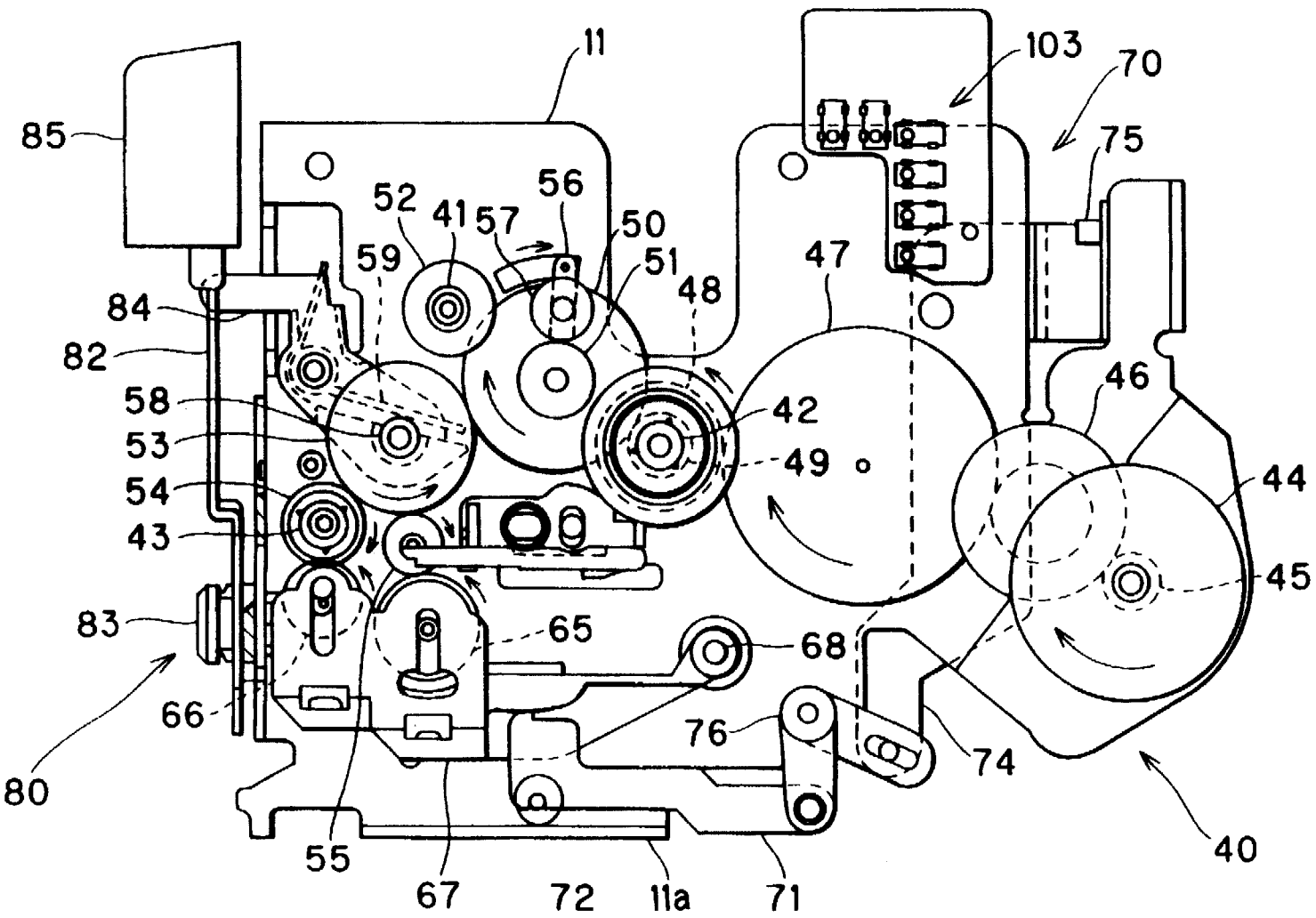
FIG. 9 is a plan view showing a drive system of the thermal printing mechanism in the printing state.
Figure 10:
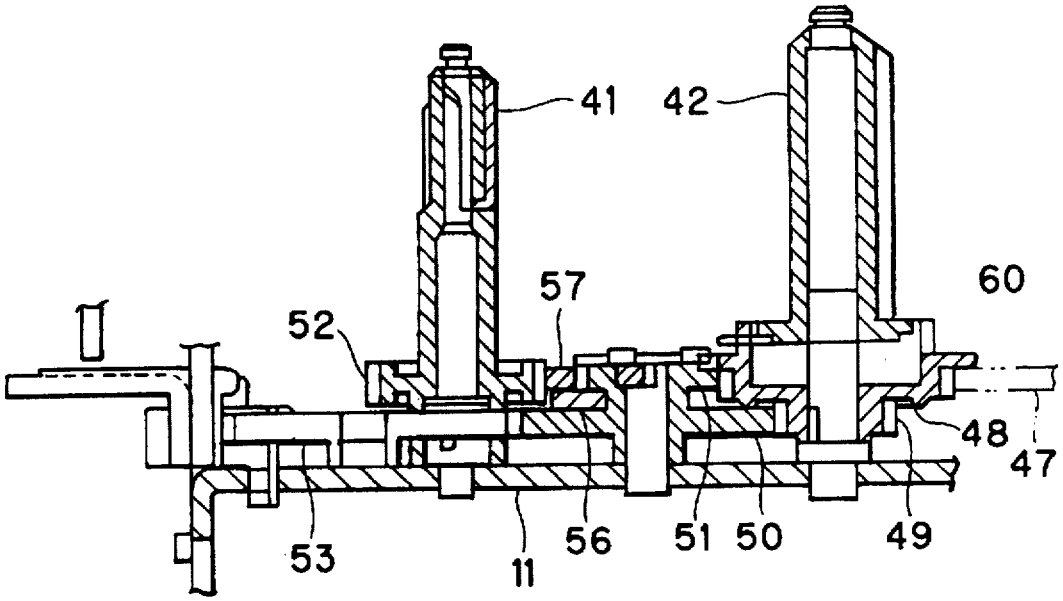
FIG. 10 is a vertical cross-sectional front view showing a gear engaging relation of essential portions in FIG. 9.

As shown in FIG. 9, when the tape drive motor 44 is driven in the clockwise direction for normal printing operation, the gear 50 rotates in the clockwise direction. In this case, the swing lever 56 is pivoted in the clockwise direction about an axis of the gear 51 because of the frictional force in association with the gears 50 and 51. Consequently, the planet gear 57 is disengaged from the tape take-up gear 52 to render the tape take-up cam 41 free. Accordingly, the printing tape 22 wound over the tape spool 23 can be paid out (no take-up force is imparted to the take-up cam 41). At the same time, the gear 53 is rotated in the counterclockwise direction, so that the cut restricting lever 84 is pivoted about an axis of the shaft 53 in the counterclockwise direction. Consequently, the end portion of the cut restricting lever 84 is brought into a position immediately below a cutting lever 82 described later, thus restricting cutting operations. At the same time, because of the rotation in the counterclockwise direction of the ribbon drive gear 48, the ribbon take-up cam 42 is also rotated in the counterclockwise direction, via a clutch spring 60. Therefore, the ink ribbon 32 is taken up by the ribbon take-up spool 34.

A roller holder 67 for rotatably supporting a rubber platen roller 65 and a rubber tape feeding subroller 66 is pivotably supported on the main frame 11 by a pivot shaft 68. A release lever 71 is provided movably in the leftward and rightward direction in interlocking relation to the opening and closing motion of the cassette cover 3. The release lever 71 changes its position between a printing position shown in FIG. 9 and a release position shown in FIG. 11.

The roller holder 67 is normally biased toward its release position by a spring not shown in the drawings. A wheel roller 72 rotatably attached to the release lever 71 is in contact with an upstanding wall 11*a* of the main frame 11. At the same time, a free end of the release lever 71 is in contact with the roller holder 67 from the rear side. Therefore, when the release lever 71 is moved in the left direction from a release position shown in FIG. 11 to an operating position shown in FIG. 9, the left end of the release lever 71 is wedged between the roller holder 67 and the upstanding wall 11*a*, so that the roller holder 67 is changed from its release position to its printing position. At this time, the platen roller 65 presses against the thermal head 12 through the printing tape 22 and the ink ribbon 32, and the tape feeding subroller 66 presses against the tape feeding roller 24 through the printing tape 22.

When the roller holder 67 is changed to the printing position, a platen gear (not shown in the drawings) fixed to the lower end portion of the platen roller 65 is brought into meshing engagement with the gear 55, and a subroller gear (also not shown) fixed to the lower end portion of the tape feeding subroller 66 is brought into meshing engagement with the tape drive gear 54.

Next, a head release mechanism 70 will be described with reference to FIG. 9 and FIGS. 11 through 13. The head release mechanism 70 is adapted for moving the roller holder 67 to its release position with respect to the thermal head 12 by moving the release lever 71 rightwardly in accordance with the opening movement of the cassette cover 3.

Figure 12:
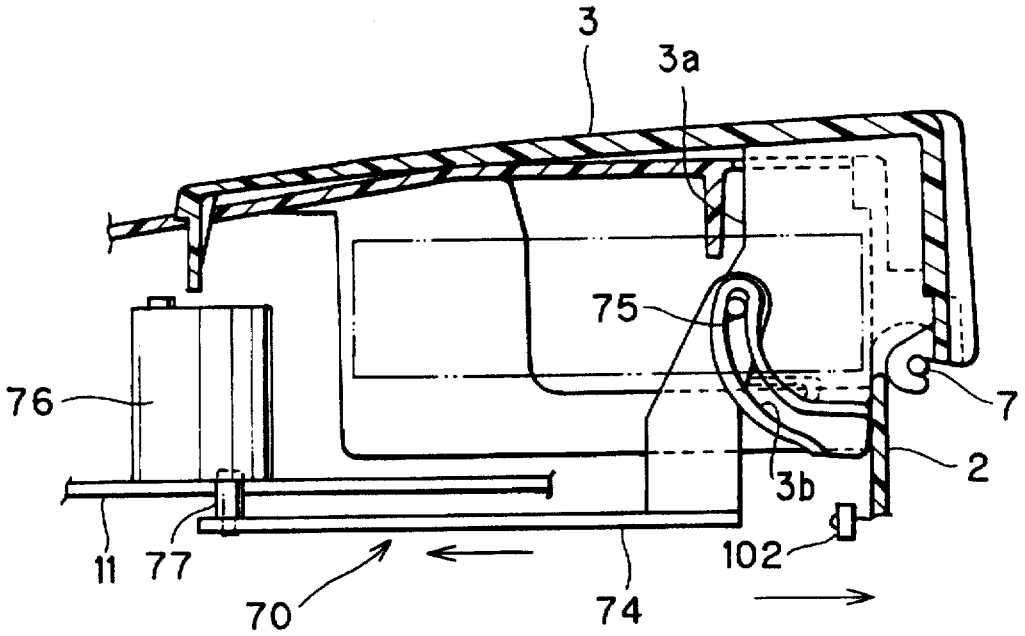
FIG. 12 is a vertical cross-sectional side view showing essential portions when the cassette cover is closed.
Figure 13:
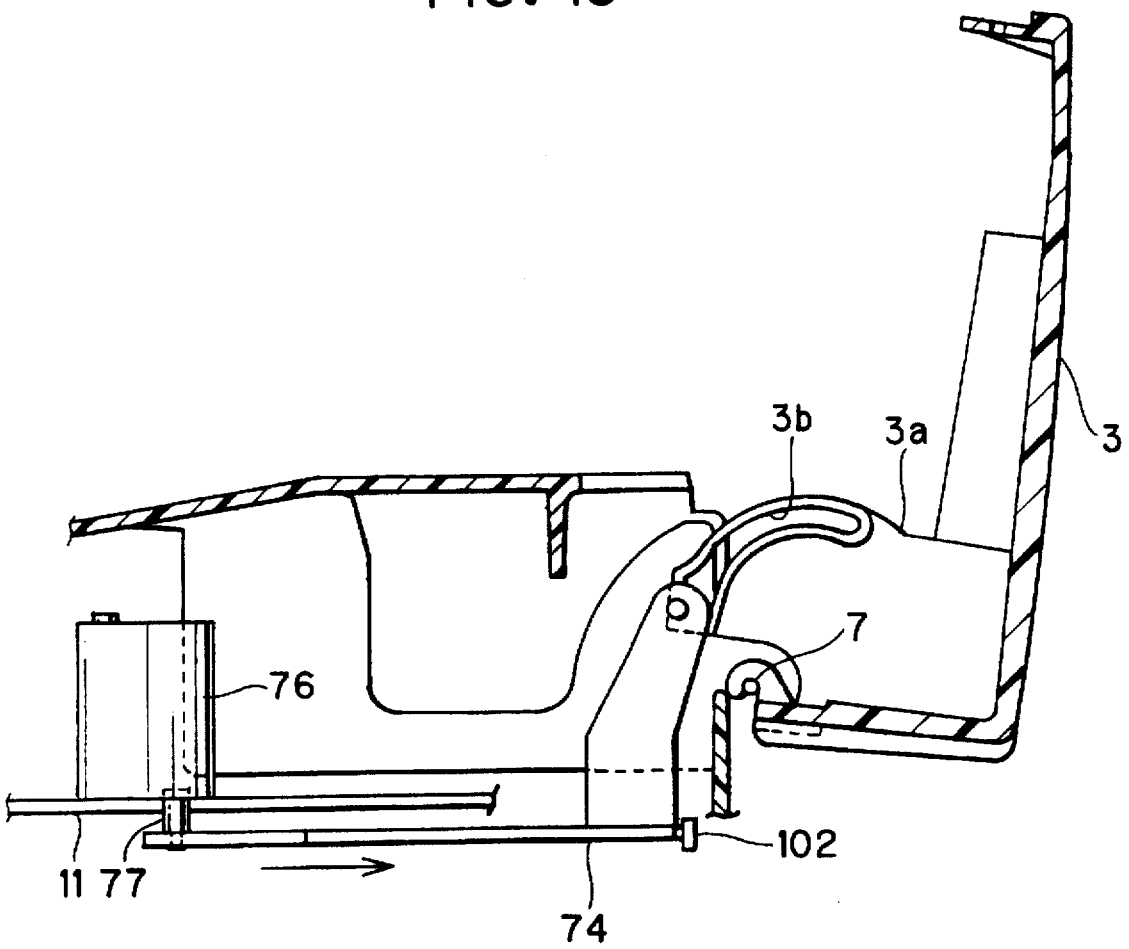
FIG. 13 is a vertical cross-sectional side view showing the essential portions when the cassette cover is open.

As shown in FIGS. 12 and 13, the rear portion of the cassette cover 3 is supported in a plurality of places by the pivotal pin 7 attached on the main cover 2 so that the cassette cover 3 can open and close. A curved, grooved cam **3*b* is formed on the right side wall 3*a* of the cassette cover 3. An operation plate 74 is positioned on the right, underside of the main frame 11, and an engaging pin 75 engageable with the grooved cam 3*b* is fixed to the rear end portion of the operation plate 74. The right end portion of the release lever 71 is pivotally supported on one arm of a forked lever 76. The forked lever 76 has the other arm connected to the operation plate 74 via a pin 77 fixed to the front end portion of the operation plate 74**.

In a state where the cassette cover 3 is closed as shown in FIG. 12, in other words, in a state where the roller holder 67 is in the printing position shown in FIG. 9, if the cassette cover 3 is then opened as shown in FIG. 13, the engaging pin 75 engaged with the grooved cam **3*b* is moved rearwardly by the movement of this grooved cam 3*b*. Therefore, the operation plate 74 is moved rearwardly, and the forked lever 76 is pivoted in the counterclockwise direction. As a result, the roller holder 67 is moved rightwardly so that the roller holder 67 is changed to the release position. When the operation plate 74 is moved rearwardly, a cover open and close signal VS of "H" level is output from a cover open and close detection switch 102**.

Figure 11:
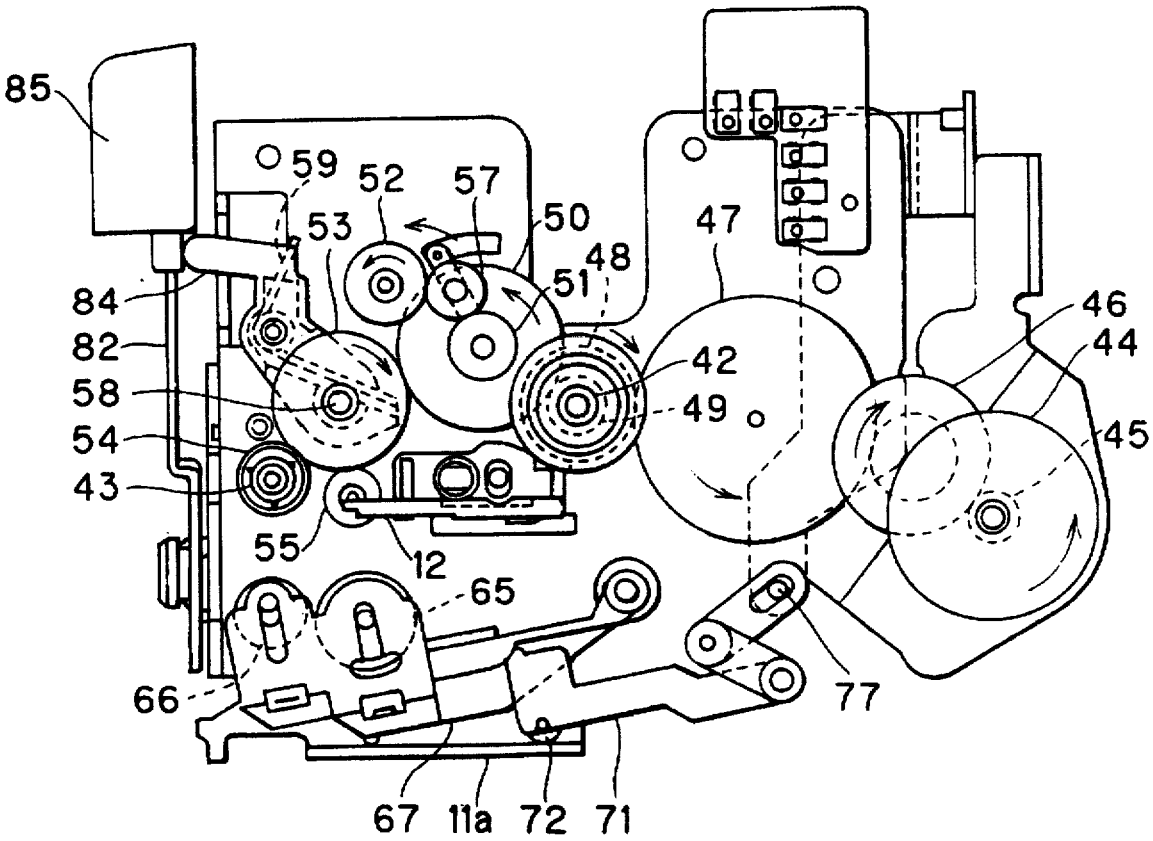
FIG. 11 is a plan view showing the drive system of the thermal printing mechanism in the tape rewinding state.

Further, when the cassette cover 3 is in the open position shown in FIG. 13, in other words when the roller holder 67 is in the release position shown in FIG. 11, and the cassette cover 3 is then closed, as shown in FIG. 12, the engaging pin 75 is moved frontwardly by the movement of the grooved cam **3*b*. Therefore, the operation plate 74 is moved frontwardly, and the forked lever 76 is pivoted in the clockwise direction from the position shown in FIG. 11. The roller holder 67 is changed to the printing position, or non-release condition, in response to the movement of the release lever 71** in the leftward direction.

Figure 2:
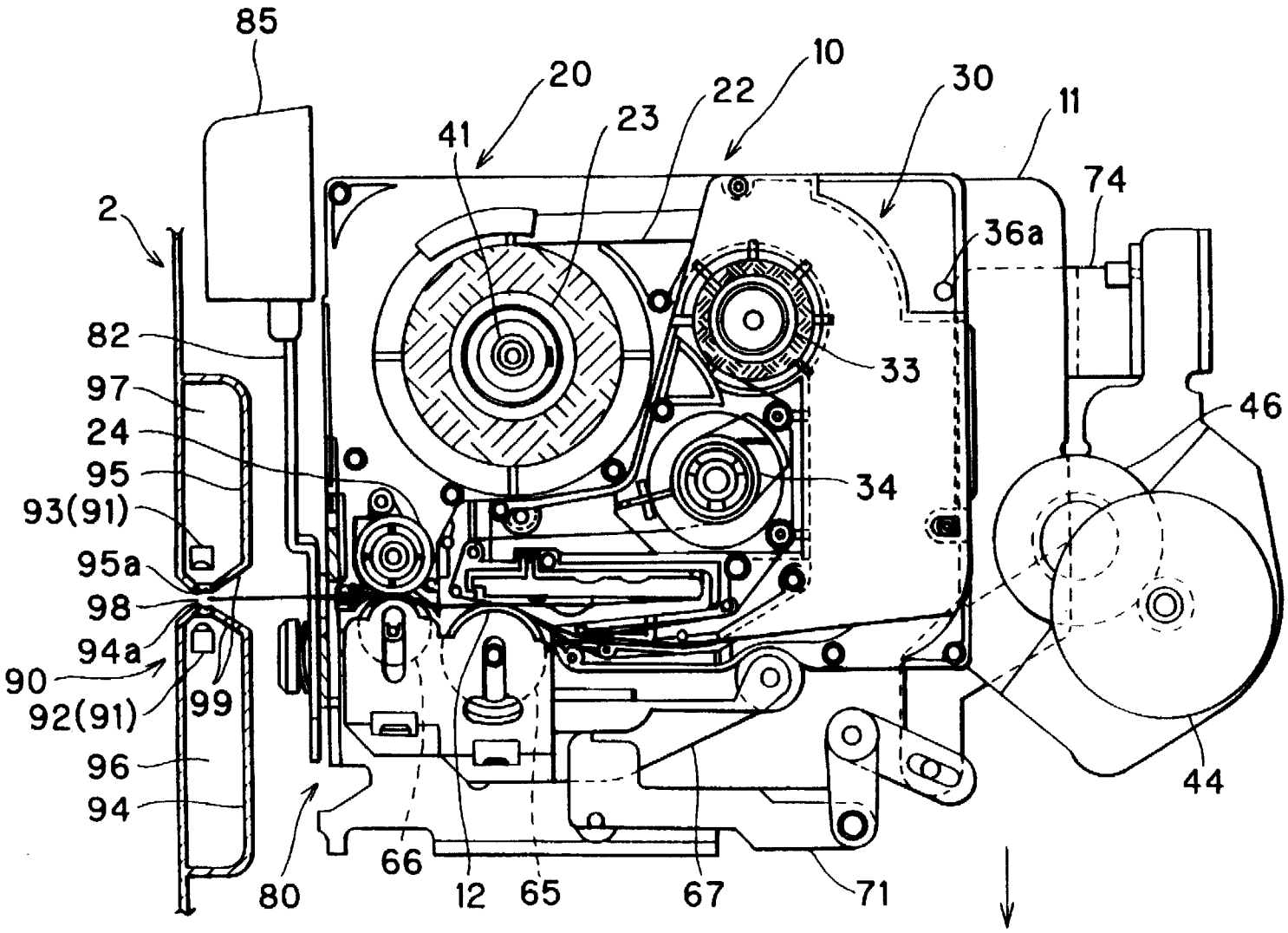
FIG. 2 is a plan view showing a thermal printing mechanism in the printing state.

As shown in FIGS. 2 and 9, for performing a printing operation, the tape cassette 20 is first mounted on the thermal printing mechanism 10. Then, the ribbon cassette 30 is mounted on the tape cassette 20. When the cassette cover 3 is closed, the roller holder 67 is shifted to the printing position.

From this position, when the tape drive motor 44 is driven in its normal printing direction, i.e., in the clockwise direction, each of the gears 45 through 55 is driven to rotate in its prescribed direction. The platen roller 65 and the tape feeding subroller 66 are each rotated in the counterclockwise direction. Further, because the tape feeding subroller 66 and the tape feeding roller 24 are in synchronous rotation, the tape passes by the tape cutting mechanism 80 and the tape detection mechanism 90 and is discharged outside, while the printing tape 22 is being printed on by the thermal head 12.

During this time, the tape take-up cam 41 is free, and, therefore, the printing tape wound over the tape spool 23 is continually supplied with no resistance. At the same time, and at the same pace as the printing tape 22, the ink ribbon 32 is supplied from the ribbon spool 33 by the rotating motion of the platen roller 65. The ink ribbon 32 is then taken up by the ribbon take-up spool 34 engaged with the ribbon take-up cam 42 which is rotated by the ribbon take-up gear 48.

Figure 3:
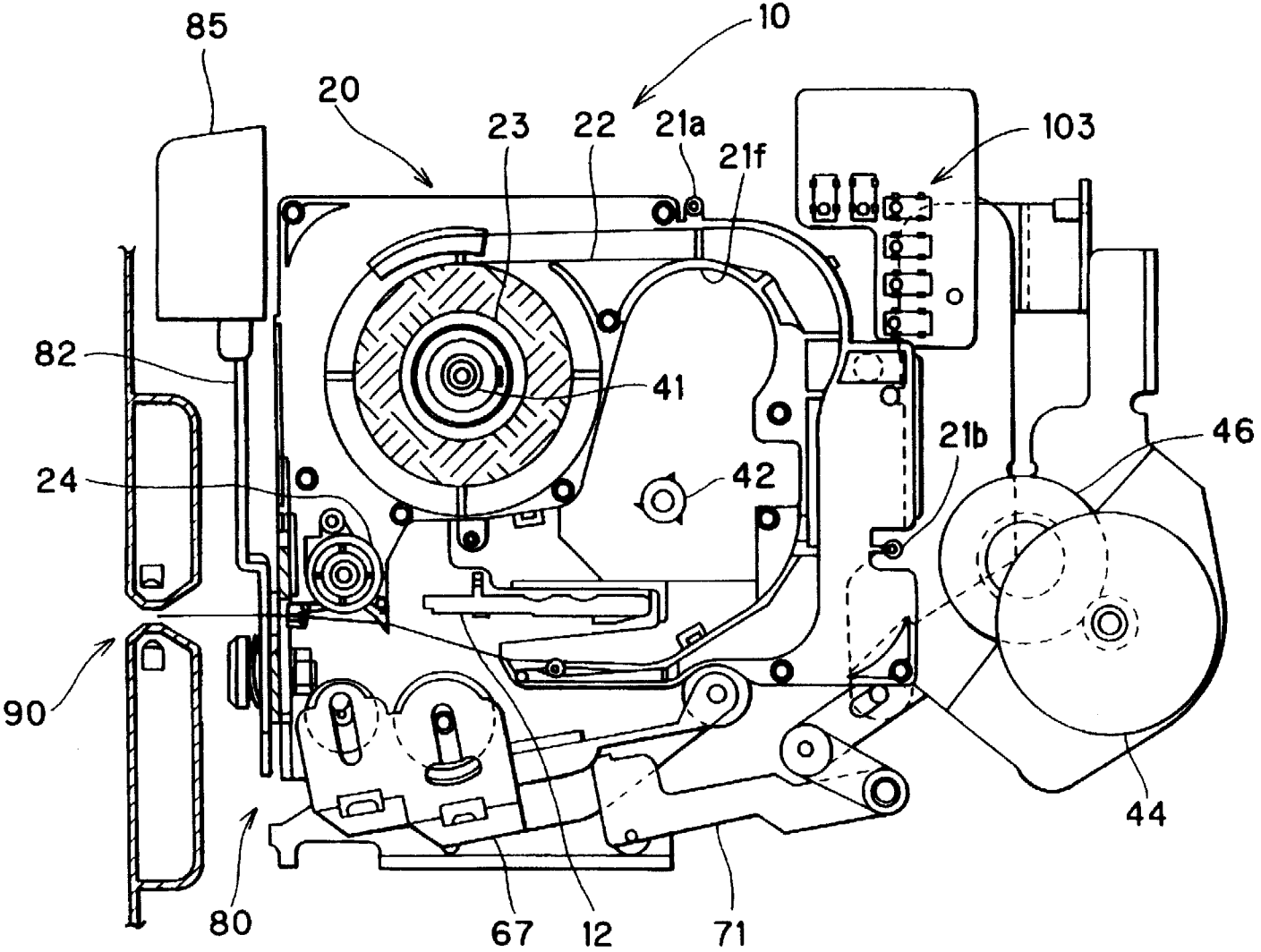
FIG. 3 is a plan view showing the thermal printing mechanism in a tape rewinding state.
Figure 4:
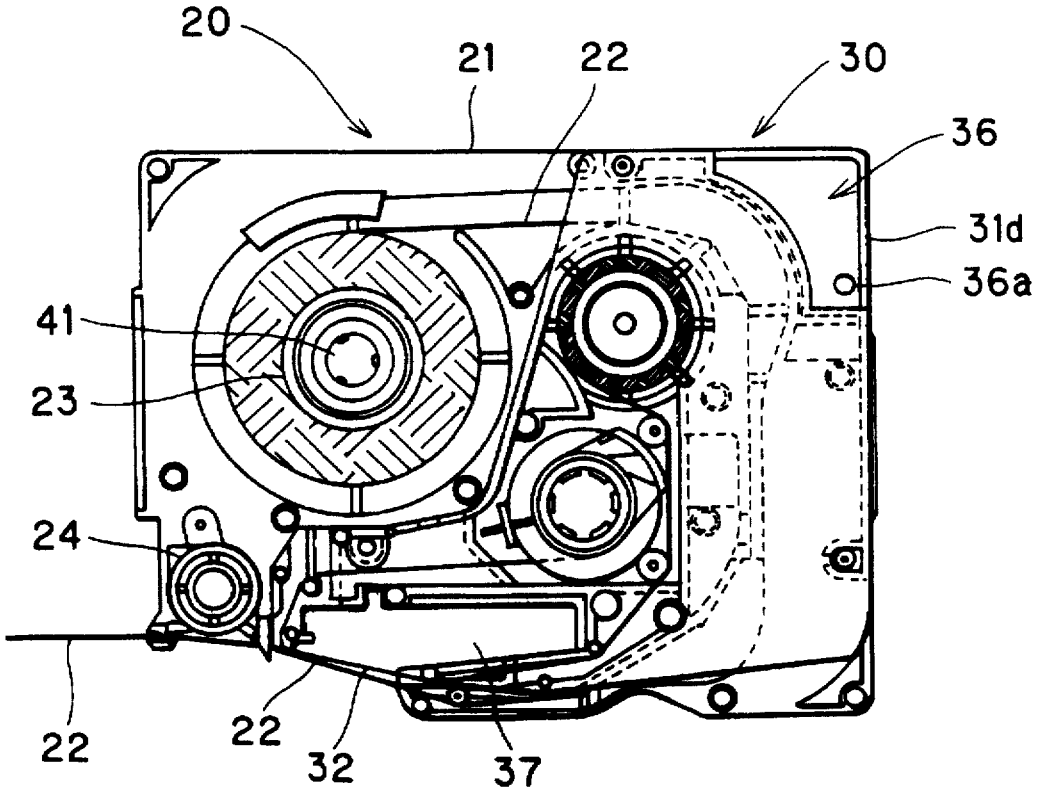
FIG. 4 is a plan view showing a tape cassette mounted with a ribbon cassette.
Figure 5:
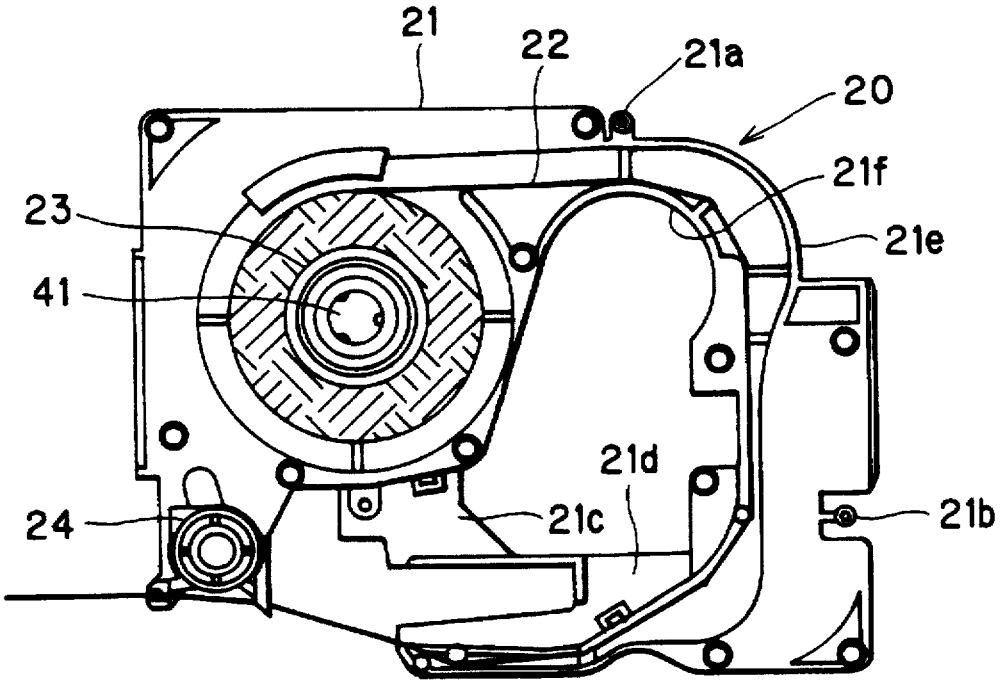
FIG. 5 is a plan view showing the tape cassette.
Figure 6:
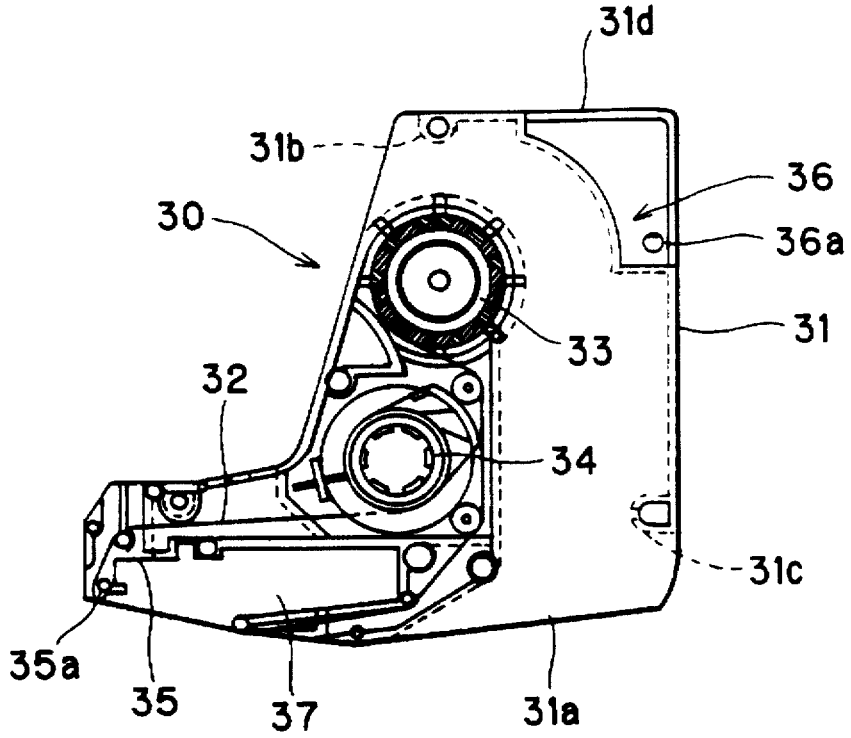
FIG. 6 is a plan view showing an internal arrangement of the ribbon cassette.
Figure 8:
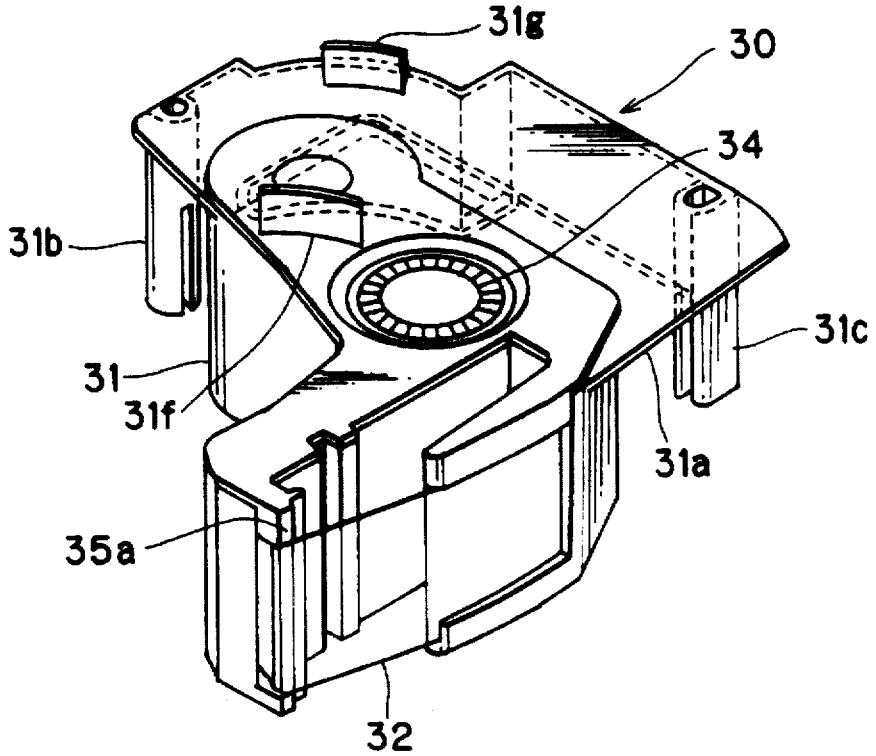
FIG. 8 is a perspective view showing the ribbon cassette.

After the printing of the first color is completed and the second color is to be printed, the cassette cover 3 is released. When the ribbon cassette 30 is removed, the roller holder 67 is changed to the release position by the head release mechanism 70. Then, when the tape drive motor 44 is driven to rotate in the counterclockwise direction, (the tape rewinding direction), each of the gears 45 through 55 is driven to rotate in its prescribed direction, as shown in FIGS. 3 and 11.

As a result of the gear 50 rotating in the counterclockwise direction, the swinging lever 56 is also pivoted in the counterclockwise direction to bring the planet gear 57 into meshing engagement with the tape take-up gear 52. Accordingly, the tape take-up cam 41 is rotated in the counterclockwise direction. Thus, the printing tape 22 that has been printed on once is taken up by the tape spool 23. At this phase, the ribbon take-up gear 48 is driven in the clockwise direction. However, the ribbon cassette 30 has been removed, and, thus, the ink ribbon 32 taken up by the ribbon take-up spool 34 is not supplied.

Figure 14:
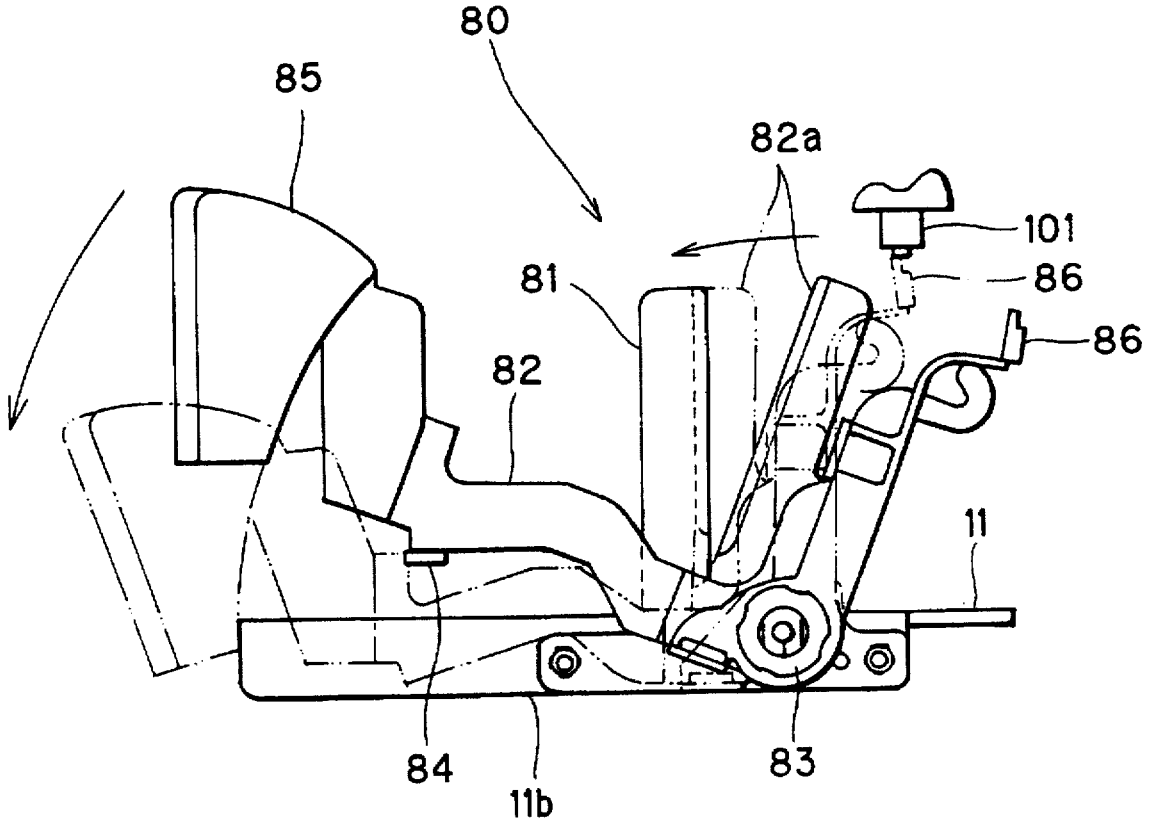
FIG. 14 is a side view showing a tape cutting mechanism of the thermal printing mechanism.

Next, a tape cutting mechanism 80 for cutting the printing tape 22 that has been printed on will be described with reference to FIGS. 14 and 15.

The main frame 11 has a left end wall **11*b* which is provided by partially bending downwardly the left end portion of the frame 11, and a lower end of a fixed blade 81 is fixed to the left end wall 11*b*. A cutting lever 82, which, from the side view, looks like an abbreviated L shape, has a base end portion pivotally supported by a screw 83 to the left end wall 11*b*. A movable blade 82*a* is formed on the cutting lever 82. As shown in FIG. 9, during the printing process, gear 53 rotates in the counterclockwise direction, moving the end portion of the cut restricting lever 84 to the under side of the cutting lever 82** and, thus, restricting the cutting operation.

Figure 15:
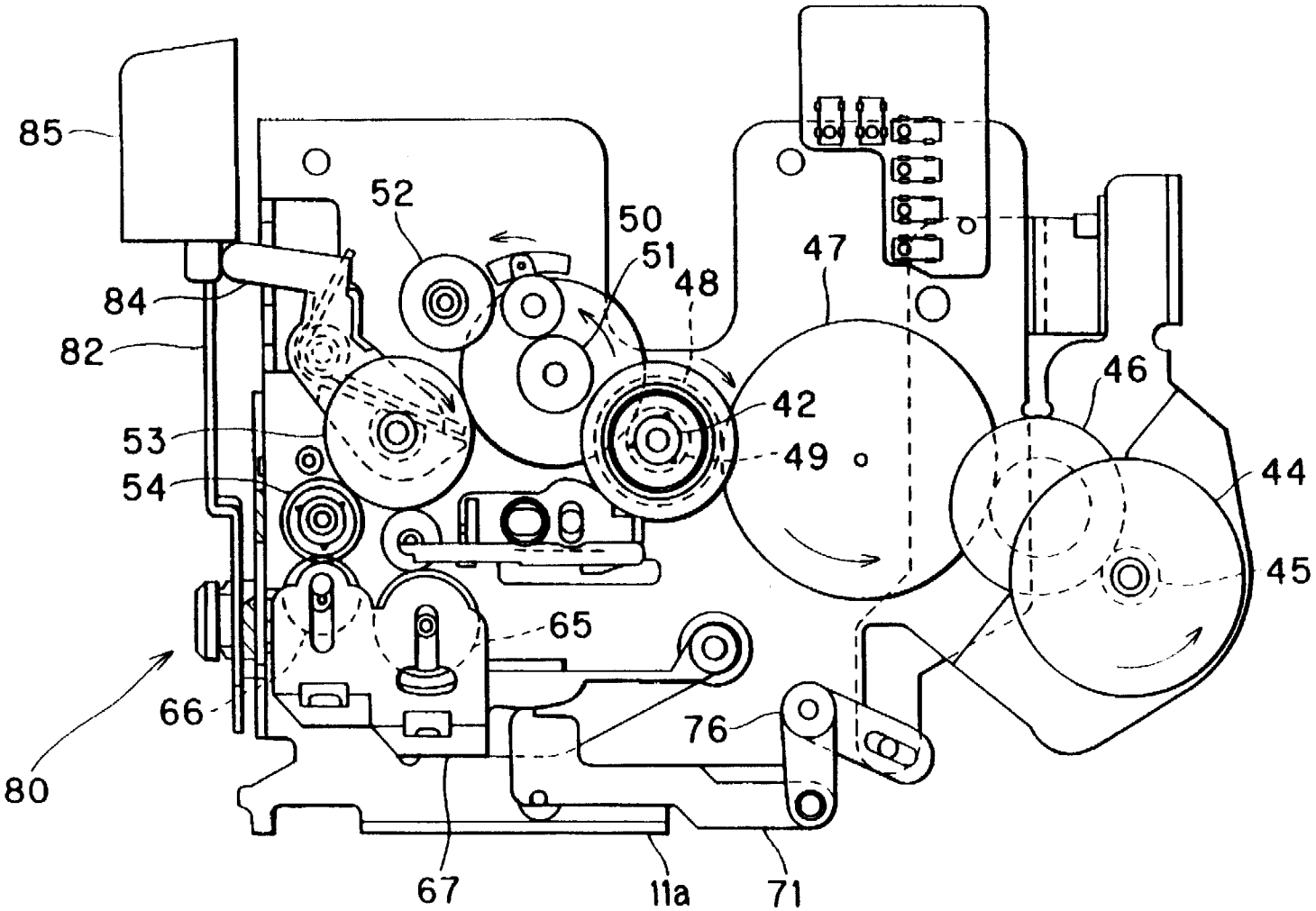
FIG. 15 is a plan view showing the drive system of the thermal printing mechanism in the tape cutting permission state.

However, when printing is completed and the tape drive motor 44 is rotated only slightly in the rewinding direction, gear 53 is rotated slightly in the clockwise direction as shown in FIG. 15, displacing the end portion of the cut restricting lever 84 from underneath the cutting lever 82 to allow cutting operations. When the cutting button 85 on the end portion of the cutting lever 82 is pushed downward as shown in FIG. 14, the movable blade **82*a* is pivoted to the cutting position indicated by a two dotted chain line. The printing tape 22 positioned between the fixed blade 81 and the movable blade 82*a* is cut through the force of these two blades. A cutting detection switch 101 installed on the main frame 11 is operated by an operation member 86 installed on the cutting lever 82 and outputs a cutting detection signal CS. After releasing pressure on the cutting lever 82, the cutting lever 82** is pivoted back to its original prescribed position indicated by the solid line, by urging force of a spring not shown.

Next, a tape detection mechanism 90, which is provided on the outer side of the tape cutting mechanism 80 to detect the existence of the printing tape 22, will be described with reference to FIG. 2.

Guiding members 94 and 95 are provided integrally with the main cover 2 at a position outside the tape cutting mechanism 90. The guiding members 94 and 95 are designed to form a tightly sealed pair of sensor accommodating chambers 96 and 97. A light emitting element 92 is installed in the sensor accommodating chamber 96, while a light receiving element 93 is installed in the sensor accommodating chamber 97. A slit 98 is formed between the pair of guiding members 94 and 95 to allow the printing tape 22 to pass therethrough. Light transmitting holes 94*a* and 95*b* having a small diameter are formed in the guide members 94, 95 in a confronting relation to each other. The slanted guides 99 are also formed at these confronting portions. The leading end of the printing tape 22 passing through the tape cutting mechanism 80 will reliably pass through this slit, because of the formation of the guides 99, so that the printing tape 22 can be accurately detected.

At this point, the sensor light emitted from the light emitting element 92 passes through the light transmitting holes 94*a* and 94*b* formed in the sensor accommodating chambers 96 and 97, and is received on the light receiving element 93. Therefore, when the printing tape 22 proceeds into the tape detection sensor 91, and the printing tape 22 is positioned between the light emitting element 92 and the light receiving element 93, the sensor's light is interrupted by the printing tape. Thus, the tape detection sensor 91 outputs an "L" level tape detection signal TS.

Figure 16:
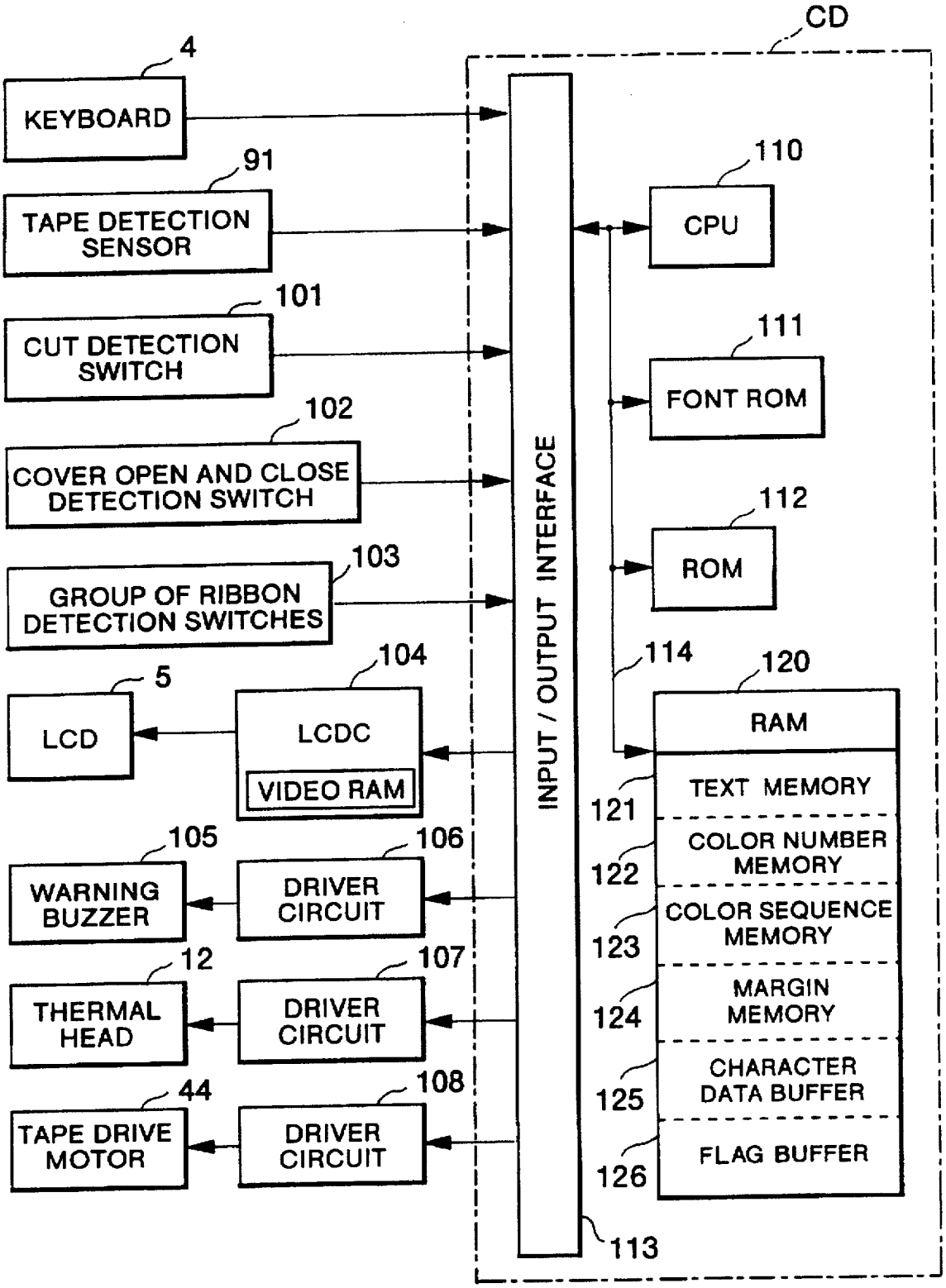
FIG. 16 is a block diagram showing a control system of the tape-shaped label printing device.
Figure 17:
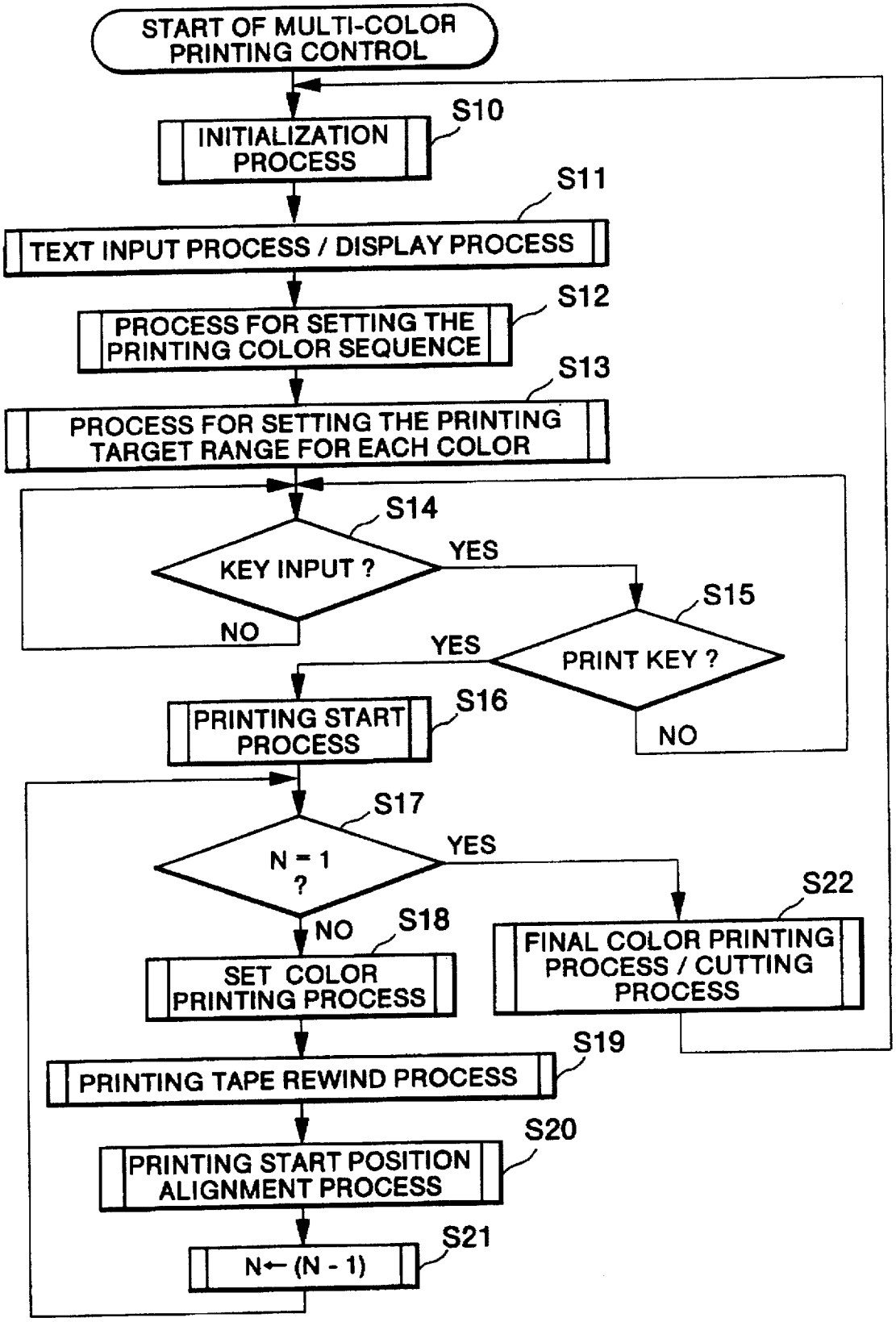
FIG. 17 is a general flowchart representing a multi-color printing control routine.

The control system of the tape-shaped label printing device 1 is configured as shown in the block diagram of FIG. 16.

Connected to an input/output interface 113 of a control device CD are the keyboard 4, the tape detection sensor 91, the cutting detection switch 101, the cover open and close detection switch 102, the group of ribbon detection switches 103, a display controller (LCDC) containing a video RAM for outputting display data to the liquid crystal display (LCD) 5, a driver circuit 106 for a warning buzzer 105, a driver circuit 107 for driving the thermal head 12, and a driver circuit 108 for the tape drive motor 44.

The control device CD includes a CPU 110, the input/output interface 113 is connected, via buses 114 including a data bus, to the CPU 110, a font ROM 111, a ROM 112, and a RAM 120.

The font ROM 111 stores dot pattern data for display, concerning all of the numerous characters, such as the alphabetic characters and symbols, and dot pattern data for printing in a plurality of printing character sizes.

The ROM 112 stores a display drive control program for controlling the display controller 104 to respond to the code data of alphabetic characters, symbols, numbers, and other characters input from the keyboard 4, a printing control program to create dot pattern data, for printing, of the characters, symbols, and the like stored in a text memory 121, a printing drive control program for outputting the created dot pattern data for each row of dots in sequence to the thermal head 12, the tape drive motor 44, and the like for printing, and a control program described later for controlling printing of multiple colors.

Incidentally, the ROM 112 stores a ribbon cassette detection table for detecting the color and width of the ink ribbon 32, based on the ribbon detection signal RS output from the group of ribbon detection switches 103, including detection switches Nos. 1 through 6.

The text memory 121 of the RAM 120 stores text data, such as alphabetic characters and symbols, input from the keyboard 4, in correspondence to the data for the printing color selected. A color number memory 122 stores data of the number of printing colors inputted. A printing color sequence memory 123 stores data of the printing color sequence selected. A margin memory 124 stores data of the size of the margin selected, where the front or top margin and rear or bottom margin are identical to each other. A printing data buffer 125 stores the developed dot pattern data corresponding to the character codes stored in the text memory 121. The flag data of the set flag SF, which represents which one of color setting or order only setting that a user has selected, is stored in the flag buffer 126. Further, the RAM 120 is provided with a memory for temporarily-storing such data as the results of computation by the CPU 110.

Next, multi-color printing control routines carried out in the control device CD of the tape-shaped label printing device 1 will be described with reference to flowcharts of FIGS. 17 through 25. Incidentally, the symbols Si (i=10, 11, 12 . . . ) in the flowcharts indicate steps.

Figures 26, 27A, 27B:
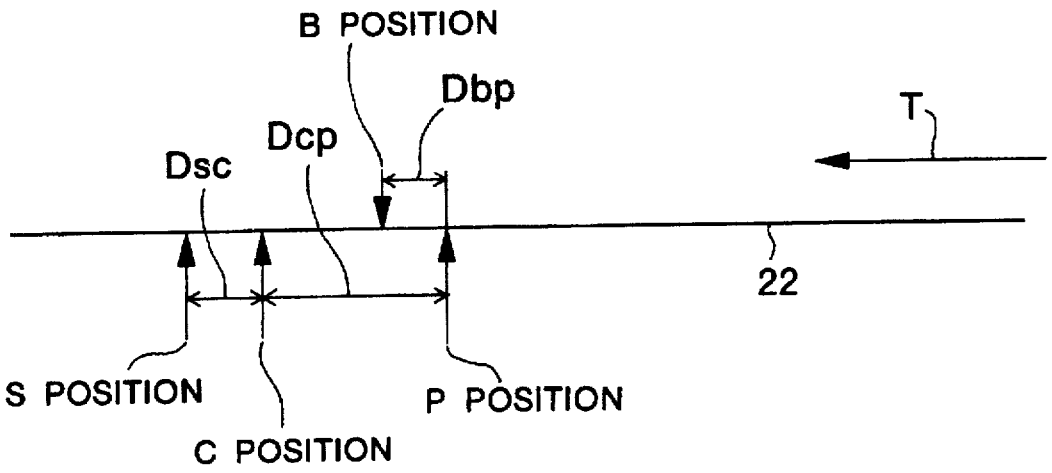
FIG. 26 is an explanatory diagram showing the positioning relationship between a printing position (P position), a tape cutting position (C position), and a tape detection position (S position)

Before entering into a substantive description as to the multi-color printing control, an explanation will be given based on FIG. 26, which shows the position of tape detection by the tape detection sensor 91, the position of tape cutting by the tape cutting mechanism 80, and the position of printing by the thermal head 12. Beginning on the upstream side in a feeding direction T of the printing tape 22, the positioning order is the printing position (P position), the tape cutting position (C position), and the tape detection position (S position). The distance (print-cut distance) between the printing position and the tape cutting position, or Dcp, is about 25 mm. The distance (cut-detection distance) between the tape cutting position and the tape detection position, or Dsc, is about 15 mm. Further, the separation position (B position), according to the separation portion 35*a* of the separation member 35, is about 6 mm downstream from the printing position in the feeding direction T.

When electrical power is supplied into the tape-shaped label printing device 1, first an initialization process is performed to initialize such devices as the thermal printing mechanism 10 and the control device CD (S10). Then, the text input screen is displayed on the display 5. After setting printing styles, processes such as the input process for inputting text data and the display process for displaying the input text are carried out. The input text data is stored in the text memory 121 (S11). For example, as shown in FIGS. 27(*a*) and 27(*b*) input text data of "AB" "CDE" and "FG" are stored in the text memory 121.

Figure 18:
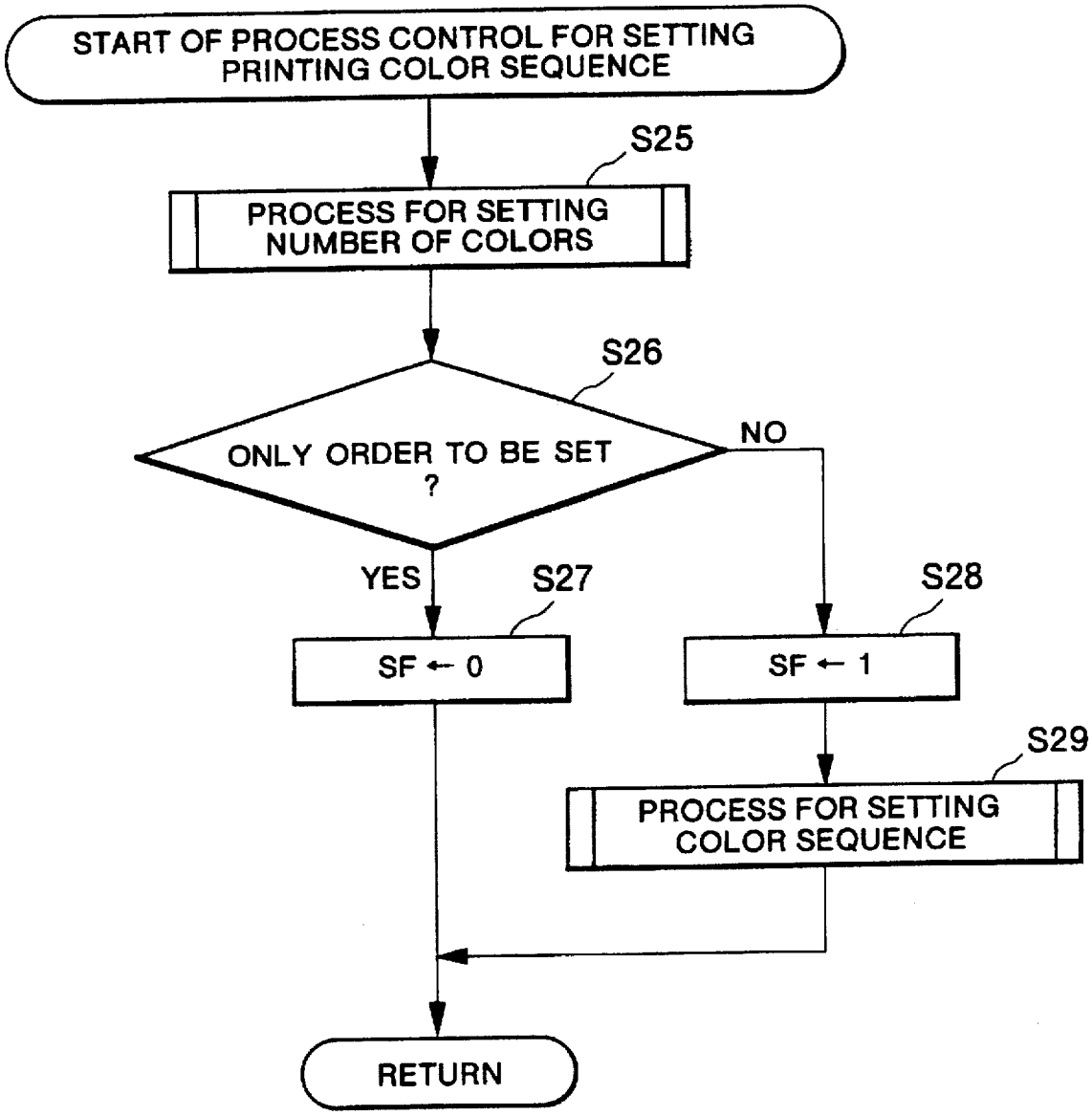
FIG. 18 is a flowchart representing a process control for setting the printing color sequence.

Next, the process control for setting the printing color sequence (S12) shown in FIG. 18 is executed.

When this control begins, the message "Number of colors?" is displayed on the display 5, and the process for setting the number of colors is executed to set the number N of colors by using the numeric keys. The number N of colors set is stored in the color number memory 122 (S25).

Next, the message saying "1 order set, 2 color set" is displayed on the display 5. Whether the user selects to have the label printing device set only an order in which characters and symbols of the text are to be printed without setting actual colors or whether the user also wishes to designate colors to print target ranges of the input text is determined in S26 according to manipulation of the number "1" key or the number "2" key in S26. That is, when the number "1"

key is manipulated, this means that the user only wishes to have an order set in which text is printed so that the label printing device 1 will append only numbers in the order of 1 to N to target ranges indicated by the user. The user then determines what numbers represent which colors. For example, a user would manipulate the "1" key when he or she wishes to print in newly added colors not registered in the tape-shaped label printing device 1. In this case, in S27, the selection flag SF is reset to "0" and the flag value is stored in the flag buffer 126. Afterward, the program returns to S13 of the multi-color printing program.

On the other hand, when the number "2" key is manipulated, this means that the user selects to also set colors in which character target ranges are printed. For example, the user would manipulate the number "2" key when all the print colors he or she desires to print in are registered in the tape-shaped label printing device 1. In this case, in S28, the selection flag SF is set to "1" and the flag value is stored in the flag buffer 126. Next in S29, a color sequence setting process is performed wherein the names of the plurality of colors are displayed on the display 5 so that the user can serially set the order he or she desires colors to be printed in. The data of color sequence set in this manner is stored in the print color sequence memory 123. This ends this routine and the multi-color print program returns to S13.

Figure 19:
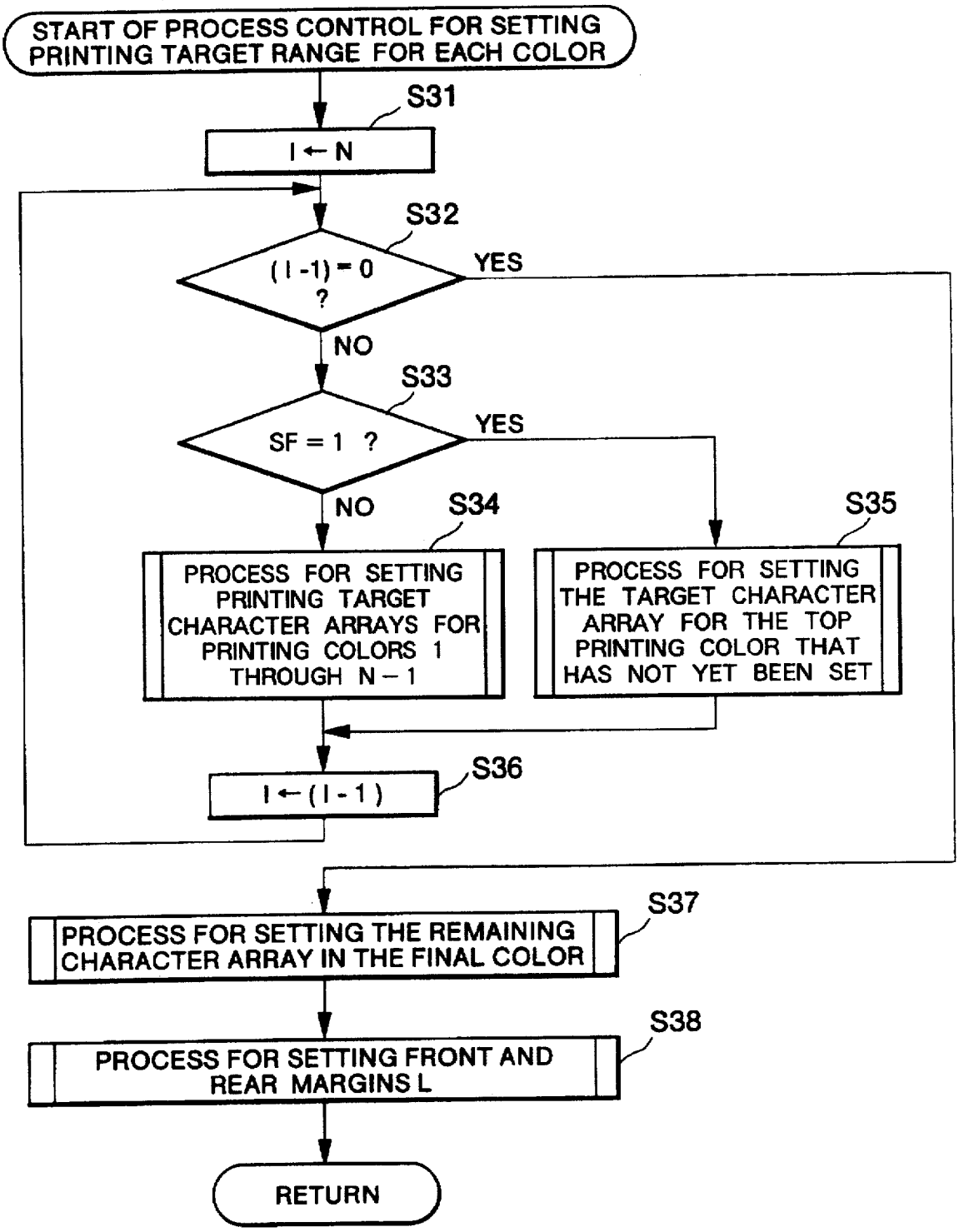
FIG. 19 is a flowchart representing a process control for setting a printing target range for each color.

Next, in the multi-color printing control, the process control for setting the printing range of each color is executed in step S13 as shown in FIG. 19.

When this control begins, the color number N is set in a color number counter as a count value I (S31). Then, in S32, the color number count value I is decremented by one and if the result is not zero, that is, if the present character array is not the last target character array to be set with an order or with a color (S32:NO), a flag value of the selection flag SF is retrieved. If the selection flag SF is zero (S33:NO), then in S34 a process for setting printing target character arrays for print colors is executed from a print color 1 to be printed first to a print color N-1 to be printed next to last. This setting is performed by indicating, with a cursor, the characters, symbols and the like constituting the target character array to be printed in each corresponding color. It should be noted that the colors 1 through N-1 can be ink ribbon colors of any ribbon cassette 30 usable in the tape-shaped label printing device 1, whether the ribbon cassette 30 was available when the tape-shaped label printing device 1 was purchased or not. Also, the user need not decide during this process which actual printer colors correspond to the print colors 1 through N-1, but can decide this during printing of the tape.

During this process for setting the printing target character arrays, the text data and a message saying "Set text to be printed in print color 1" are displayed in the display 5. The user operates the four cursor movement keys provided on the right side of the keyboard 4 to indicate, with the cursor, those characters, symbols and the like in the printing target range he or she wishes to print in the first color. Each time the user sets a character or symbol of the target range, he or she presses a color set key. When all characters and symbols desired to be printed in the first color have been set, the user presses a set key, whereupon the print color 1 for the set order data is appended to the character data of the characters indicated by operating the cursor movement keys and pressing the color set key, and this data is stored in the text memory 121.

In the same manner, the user the cursor movement key and the color confirmation key to set character ranges for the second to the N-1 number printing colors. Data for the order of the print color 2 to the print color N-1 is stored in the text memory 121 in correspondence with the character data of set characters. In this way, the user can set the order in which he or she wants to print text.

On the other hand, when the selection flag SF is set to "1" (S33:YES), then a process is executed in S35 for setting characters and symbols of the printing target character range desired to be printed in the top, yet unset, print color of the color sequence data. This setting is performed by indicating, with the cursor, the characters, symbols, and the like constituting the target character range desired to be printed in the corresponding print color.

That is, during this process for setting the printing target character array, the text data is displayed on the display 5. By operating the four cursor movement keys provided on the right side of the keyboard 4, the user indicates, with the cursor, each character, symbol and the like in the printing target to be printed in any of the printing colors registered in the label printing device 1 except for the last printing color. Each time the user wants to set a character or symbol or symbol with the leading print color C, he or she presses the color set key. Each time the user completes setting of the printing target character arrays, he or she presses the set key. By pressing this set key, the set color data is appended to the character data of the characters indicated by operating the cursor movement keys and pressing the color set key, and this data is stored in the text memory 121.

Each time the processes in S34 or S35 are completed, the color number count value I is decremented 1 (S36), and steps S34 through S36 are repeated until (I−1) equals zero. When (I−1) equals zero, that is, when the setting of the printing target character array with respect to all of the printing orders or colors except the last order or color have been completed (S34:YES), a process for setting the character array is executed in S37 in order to set the remaining characters and symbols in the text data that have not already been set in connection with the last printing order or color.

Next, the process for setting the remainder of the character array will be described in detail with reference to FIG. 20. First, the character data stored in the text memory 121 is read from the top of the memory (S371). The data is checked to see if order data or color data is appended or not (S372). If order data or color data is appended to the character data read (S372:YES) and that character data is not the last of the character data (S373:NO), then the next data is read (S374), and the process is repeated from S372. However, if order data or color data is not appended to the character data read (S372:NO), order data or color data corresponding to the final printing color is appended to that character data and stored in memory (S375), and the process at S373 is executed. All of the above-mentioned processes are repeated until the end of the character data stored in the text memory 121. When the data is found at S373 to be the last of the character data (S373:YES), then control is returned to S38 of FIG. 19.

Next, an example will be provided for when order setting is selected while the character data "AB CDE FG" is stored in the text memory 121 and the color number is set to 3. During the process for setting the printing target character array in S35, first the character array "AB" is set for the printing color 1 to be printed first by operating the cursor keys and the color set key. As shown in FIG. 27(*a*), the order data "1" is appended to the character data for "A" and "B" in the text memory 121, and these combinations of character data and color data are stored in the memory. Next, the character array "CDE" is set for the printing color 2 to be printed second and the color data "2" is appended to the character data for "C" "D" "E" in the text memory 121, and stored.

When setting of the printing color 2 is completed, the color number count value I is such that (I–1) is zero. Therefore, in the process for setting the last character array in S37, the character data of the text memory 121 is read in order, beginning from the top of the memory. The character array "FG" of the text data, which has not been set to a printing color, is automatically set to the printing color 3, which is the final color in the printing order. The order data "3" is then saved in the text memory 121, appended to the character data "F" and "G".

Next, an example will be provided for when color setting is selected, while the character data "AB CDE "FG" is stored in the text memory 121, the color number is set to "3," and the color sequence is set to "red," "green," and "black." During the process for setting the printing target character array in S35, first the character array "AB" is set for the printing color red by operating the cursor keys and the color set key. As shown in FIG. 27(*b*), the color data "red" is appended to the character data for "A" and "B" in the text memory 121, and each combination of character data and color data is stored in the memory. Next, the character array "CDE" is set for the printing color "green," and the color data "green" is appended to the character data for "C" "D" "E" in the text memory 121, and stored.

When setting of the printing color "green" is completed, the color number count value I is such that (I–1) is zero. Therefore, in the process for setting the character array in S37, the character data of the text memory 121 is read in order, beginning from the top of the memory. The character array "FG" of the text data, which has not been set to a printing color, is automatically set to the final printing color, "black" and the printing data "black" is then saved in the text memory 121, appended to the character data for "F" and "G".

Next, the message "Margin for the printing tape?" is displayed in the display 5. The margins are set to the desirable size by operating the number keys, and the margin set is stored in the margin memory 124 (S38). Control is then returned to S14 for continuing the multi-color printing control.

Figure 21:
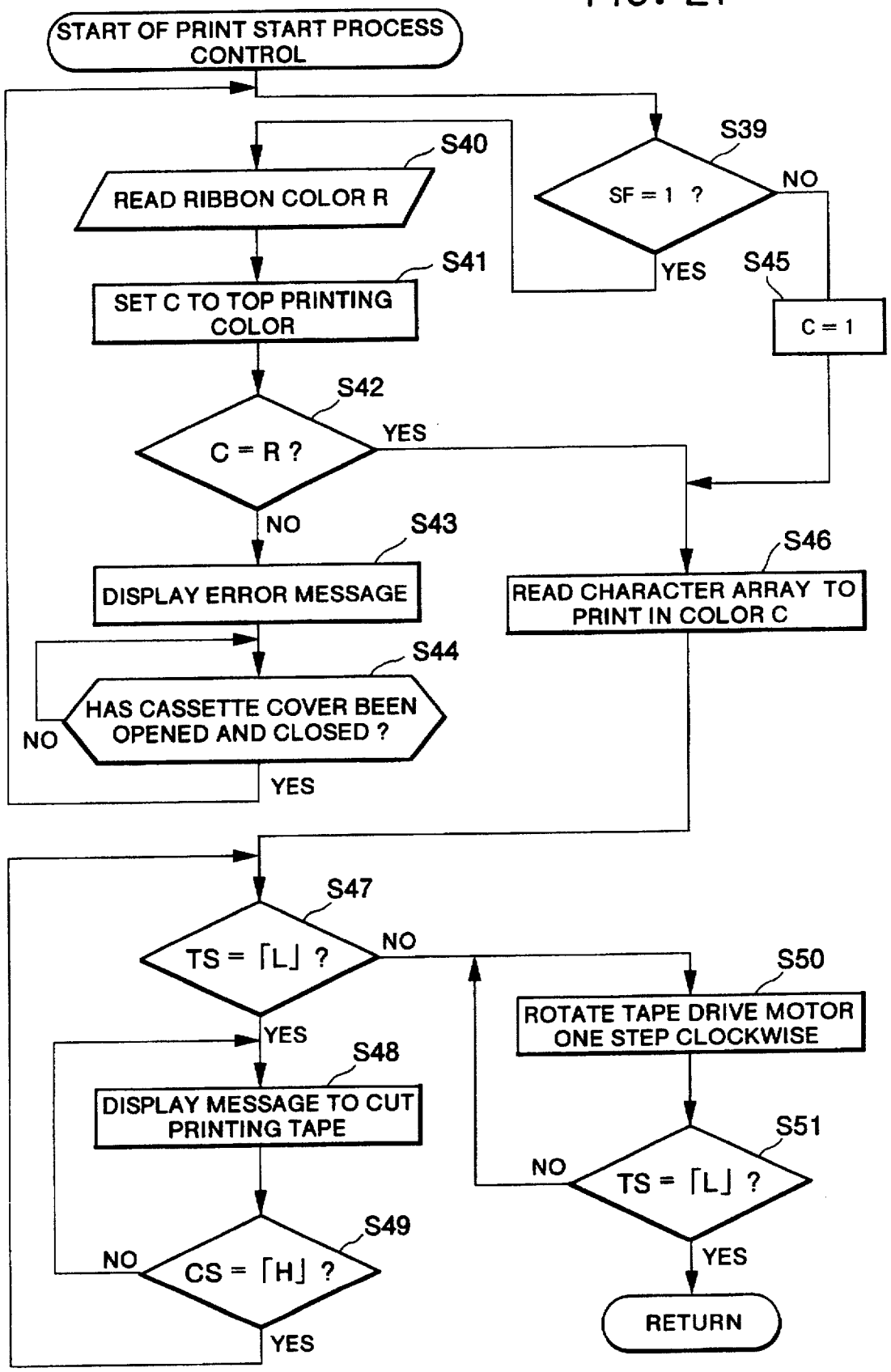
FIG. 21 is a flowchart representing a print start process control routine.

When the printing key is pressed in the multi-color printing control (S14:YES, S15:YES), the printing start process control (S16) is executed, as shown in FIG. 21.

When this process begins, first, whether the selection flag SF is "1" or not is determined in S39. If it is "1", the ribbon color R of the mounted ribbon cassette 30 is read (S40), based on ribbon detection signals RS from the group of ribbon detection switches 103. Then, the leading printing color C in the printing color sequence is read (S41). If the ribbon color R does not match the leading printing color C (S42:NO), then an error message is displayed in the display 5 (S43) indicating that the ribbon color does not match the printing color.

Then steps S40 and S41 are repeated after the cassette cover 3 is opened, the ribbon cassette 30 is replaced, and the cassette cover 3 is closed again, as determined according to the cover open and close signals VS transmitted from the cover open and close detection switch 102.

Then, if the ribbon color R matches the leading printing color C (S42:YES), or the selection flag SF is "0" (S39:NO) and the leading printing color C is set to "1" (S45), the stored character array appended with color data or order data of the leading printing color C is read from the text memory 121. Further, the dot pattern data of that character array is developed in the printing data buffer 125 (S46). Then, the tape detection signal TS is read from the tape detection sensor 91. If the tape detection signal TS is "L" level, meaning the printing tape 22 is positioned corresponding to the tape detection sensor 91 (S47:YES), then a message prompting that the printing tape be cut is displayed in the display 5 (S48).

Next, the cutting button 85 is pressed for cutting the printing tape 22, and the cut detection signal CS from the cut detection switch 101 becomes "H" level (S49:YES). When the tape detection signal TS becomes "H" level, meaning the tape cutting was detected (S47:NO), the tape drive motor 44 is driven one step only in the clockwise direction, and the printing tape 22 is moved a very small distance in the feeding direction T, in order for the leading edge of the tape to penetrate the tape detection sensor 91 (S50). As far as the tape detection signal TS maintains an "H" level (S51:NO), steps S50 and S51 are repeated.

Figure 28A:
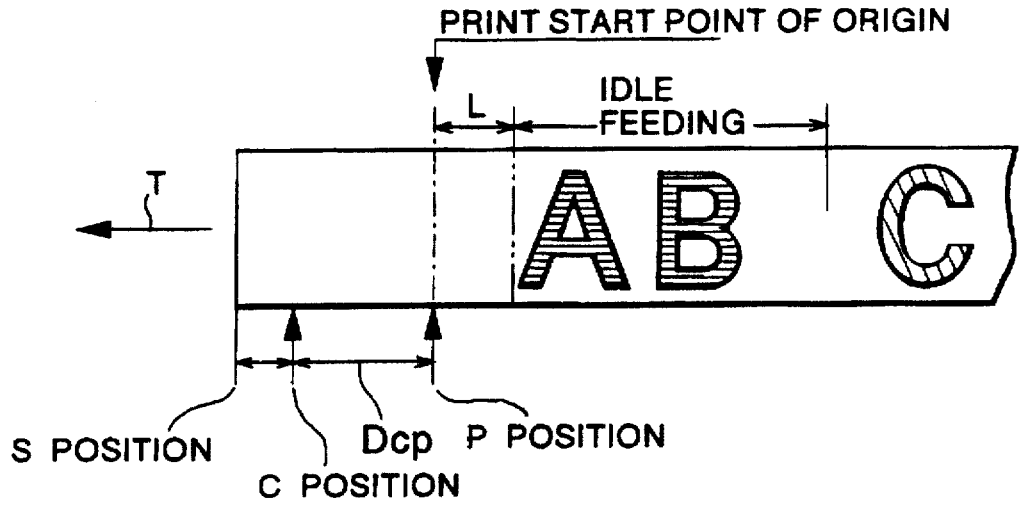
FIG. 28(*a*) is an explanatory diagram showing a print start point of origin on a tape.
Figure 28B:
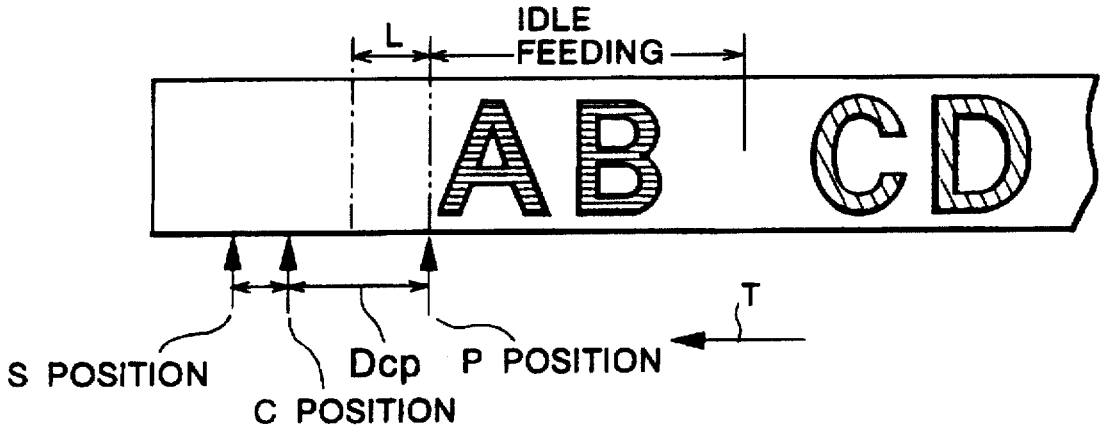
Figure 28C:
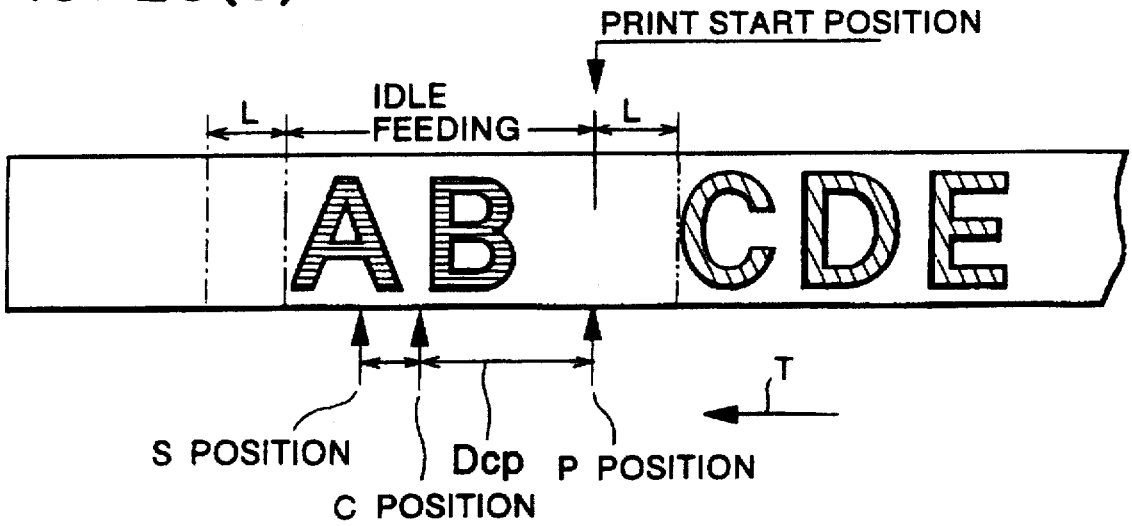

When the tape detection signal TS becomes "L" level, as shown in FIG. 28(*a*) signifying that the leading edge of the printing tape 22 has penetrated the tape detection sensor 91 (S51:YES), control is returned to S17 of the multi-color printing control. At this time, the printing position of the thermal head 12 corresponding to the printing tape 22 at the point when the leading edge of the tape was detected is set as the print start point of origin. When moving the printing tape 22 in the feeding direction T, even if the leading edge of the printing tape is curled, the leading edge of the printing tape can be reliably guided through the slit 98 by means of the guides 99 formed on the pair of guide members 94 and 95.

Figure 22:
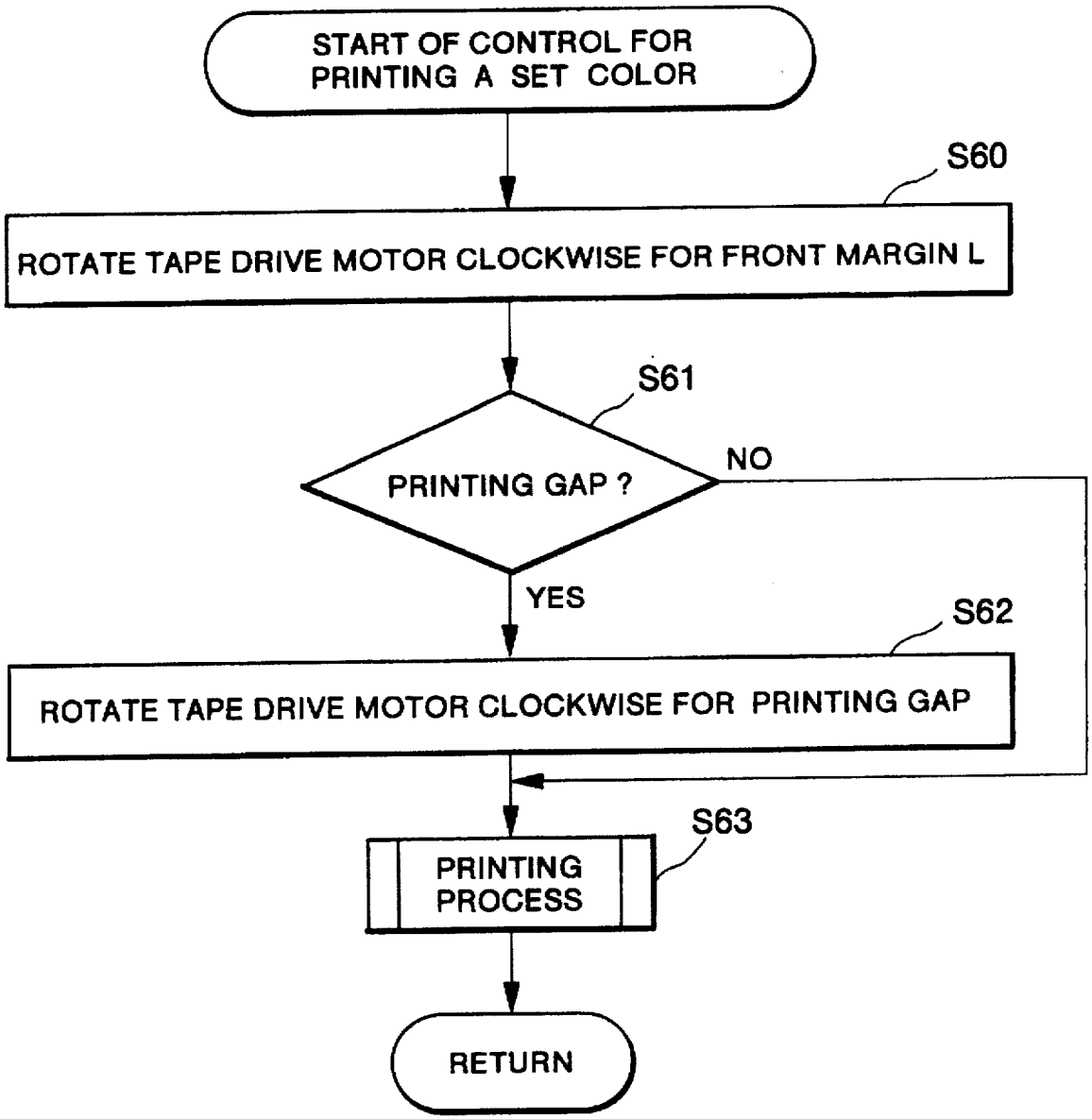
FIG. 22 is a flowchart representing a process for setting the color.

Next, in the multi-color printing control, when the color number N is not "1", that is, when the printing process is not on the last color (S17:NO), the process for setting the color (S18) is executed to print the selected printing color as shown in FIG. 22.

As shown in FIG. 28(b), when this control begins, first, the tape drive motor 44 is driven in the clockwise direction to move the printing tape the initial margin L corresponding to the set front margin L (S60). Then, if the printing start position of characters to be printed in the current printing color is positioned upstream in the feeding direction T of the print start point of origin in the label printing (S61:YES), for example, as shown in FIG. 28(*c*), if idle feeding (or feeding without printing) is required such that the characters "CDE" with the printing color "green" is to be printed, the tape drive motor 44 is driven in the clockwise direction, moving the printing tape 22 in the feeding direction T only the amount of the idle feeding (S62). However, when no idle feeding of the tape is required (S62:NO), the routine is skipped into the step S63 without executing the step S62. The dot pattern data developed in the printing data buffer 125 is read, and the printing process is executed by driving the thermal head 12, the tape drive motor 44, and the like for printing (S63). Control is then returned to S19 of the multi-color printing control.

Figure 23:
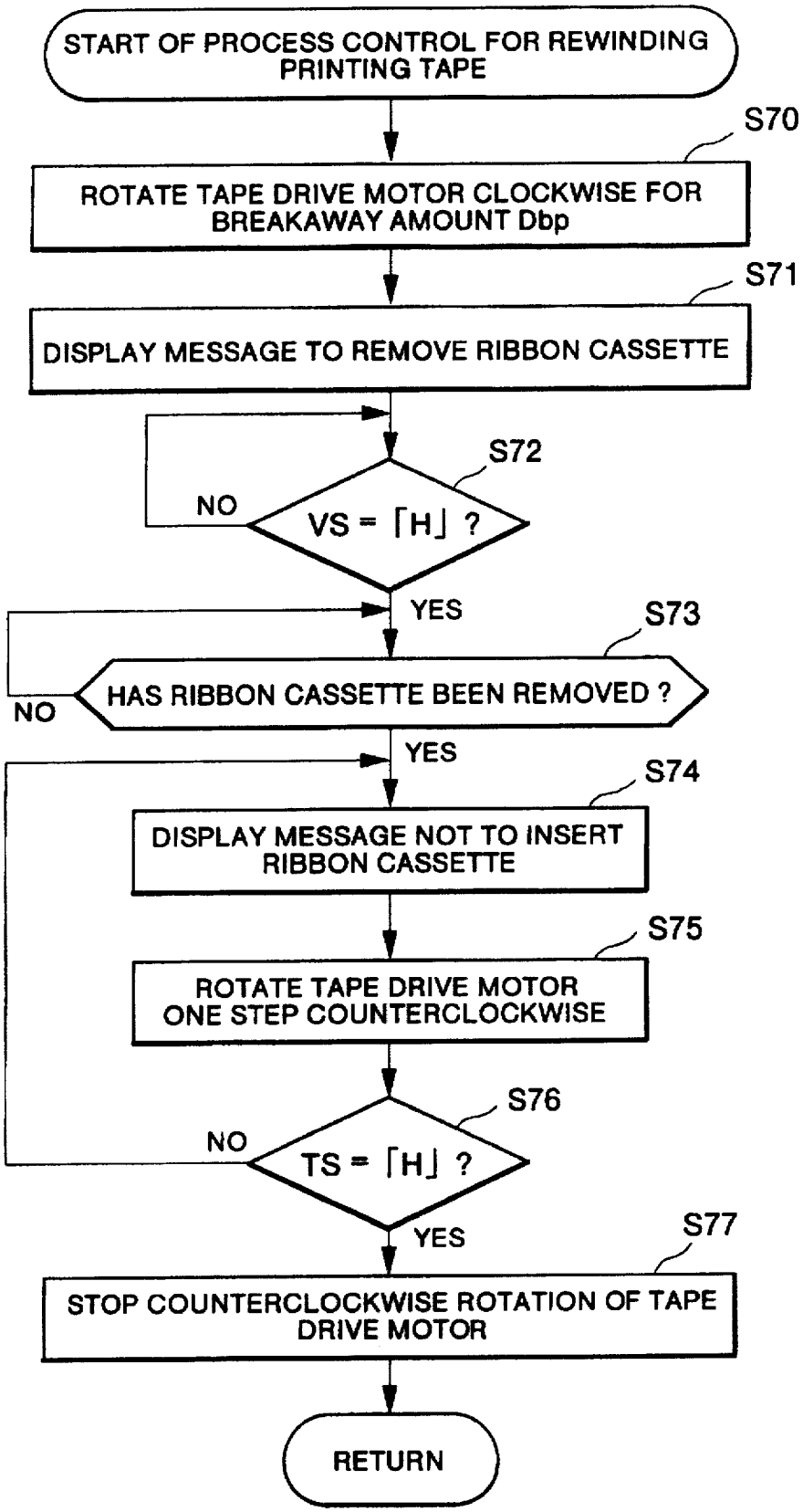
FIG. 23 is a flowchart representing a printing tape rewinding process control.

Next, in the multi-color printing control, the printing tape rewinding process control (S19) is executed as shown in FIG. 23.

When this control is begun, first, the tape driving motor 44 is driven in the clockwise direction, moving both the printing tape 22 and the ink ribbon 32 in the feeding direction T for only the separation feeding distance Dbp corresponding to the distance Dbp between the printing position (P position) and the separation position (B position) (S70). This feeding is required because the ink of the ink ribbon 32 is fused or melted to the printing tape 22 by the thermal head 12 at the final printing position. However, because the printing tape 22 and the ink ribbon 32 are moved for only the separation feeding distance Dbp, the ink ribbon 32 is forcibly pulled away from the printing tape by the separation portion 35*a*. Thus, the printing tape 22 and the ink ribbon 32 are separated with certainty.

Next, so that the user will replace the ribbon cassette 30 with one to be used next in order or with one that has an ink ribbon 32 of the same color as the next printing color, a message prompting for the ribbon cassette 30 to be removed is displayed in the display 5 (S71). Then, the cassette cover 3 is opened, moving the operation plate 74 in the rearward direction, and an "H" level cover open and close signal VS is output from the cover open and close detection switch 102 (S72:YES). In addition, all six of the detection switch signals become "H" level signals, as the ribbon detection signal RS from the group of ribbon detection switches 103. When the ribbon cassette 30 has been removed (S73:YES), a message prompting the user not to insert another ribbon cassette 30 is displayed in the display 5 (S74).

Next, to rewind the printing tape 22, the tape drive motor 44 is driven one step only in the counterclockwise direction, moving the printing tape 22 a very slight distance in the rewind direction (S75). During this rewinding operation, if the tape detection signal TS is "L" level (S76:NO), steps S74 through S76 are repeated. Then, if the leading edge of the printing tape 22 is rewound until it is slightly on the inner side of the tape detection sensor 91, the counterclockwise rotation of the tape drive motor 44 is stopped (S77). Control is then returned to S20 of the multi-color printing control.

Figure 24:
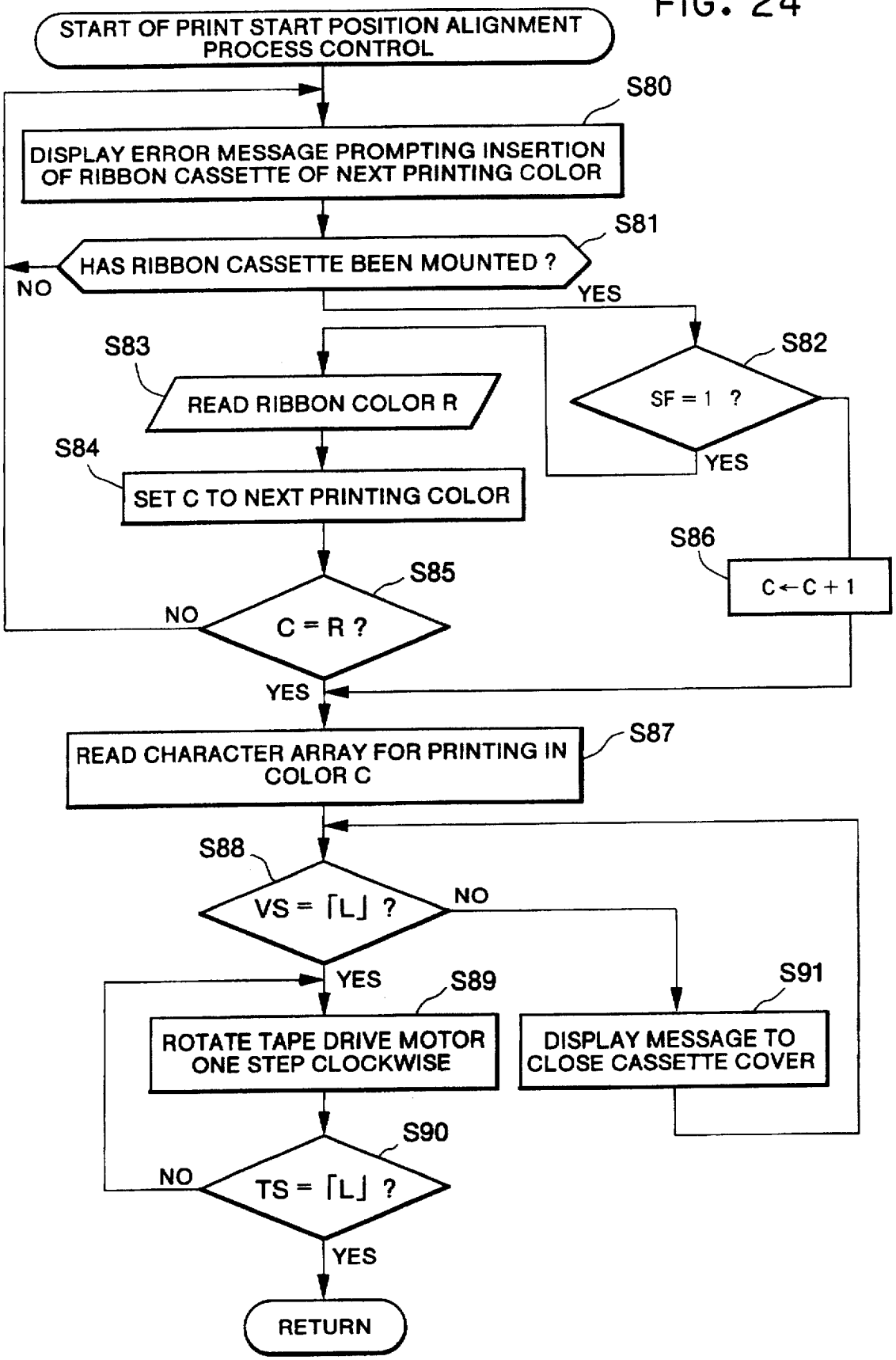
FIG. 24 is a flowchart representing a print start position alignment process control.

Next, in the multi-color printing control, the printing start position alignment process control (S20) is executed, as shown in FIG. 24.

When this control is begun, first, an error message prompting the user to insert a ribbon cassette to be used next in order or a ribbon cassette 30 having an ink ribbon 32 of the same color as the next printing color is displayed in the display 5 (S80). Then, if all of the six switch signals making up the ribbon detection signal RS are not the "H" level, signifying that the ribbon cassette 30 is mounted (S81:YES), whether or not the selection flag SF is "1" is determined (S82). If it is "1" (S82:YES), then the ribbon color R of the mounted ribbon cassette 30 is read based on the ribbon detection signals RS (S83). Then, the next printing color C of the printing color sequence is read (S84). If the ribbon color R does not match the next printing color C (S85:NO), then steps S80 through S85 are repeated.

When the ribbon color R matches the next printing color C (S85:YES), or the selection flag SF is "0" (S82:NO) so that the leading printing color C is incremented by one to indicate the next order data in the text memory 121 (S86), then accordingly the stored character array appended with the color data or order data for the next printing color C is read from the text memory 121. Further, dot pattern data for that character array is developed in the printing data buffer 125 (S87).

When the cassette cover 3 is not closed (S88:NO), a message prompting for the cassette cover 3 to be closed is displayed in the display 5 (S91). When the cassette cover 3 has been closed (S88:YES), the tape drive motor 44 is driven one step only in the clockwise direction, until the leading edge of the printing tape 22 corresponds to the tape detection sensor 91 (S89 and S90:NO). If the tape detection signal TS becomes "L" level when the leading edge of the printing tape 22 corresponds to the tape detection sensor 91, the print start point of origin for the printing tape 22 corresponds to the print position of the thermal head 12 (S90:YES). Control is then returned to S21 of the multi-color printing control.

Figure 25:
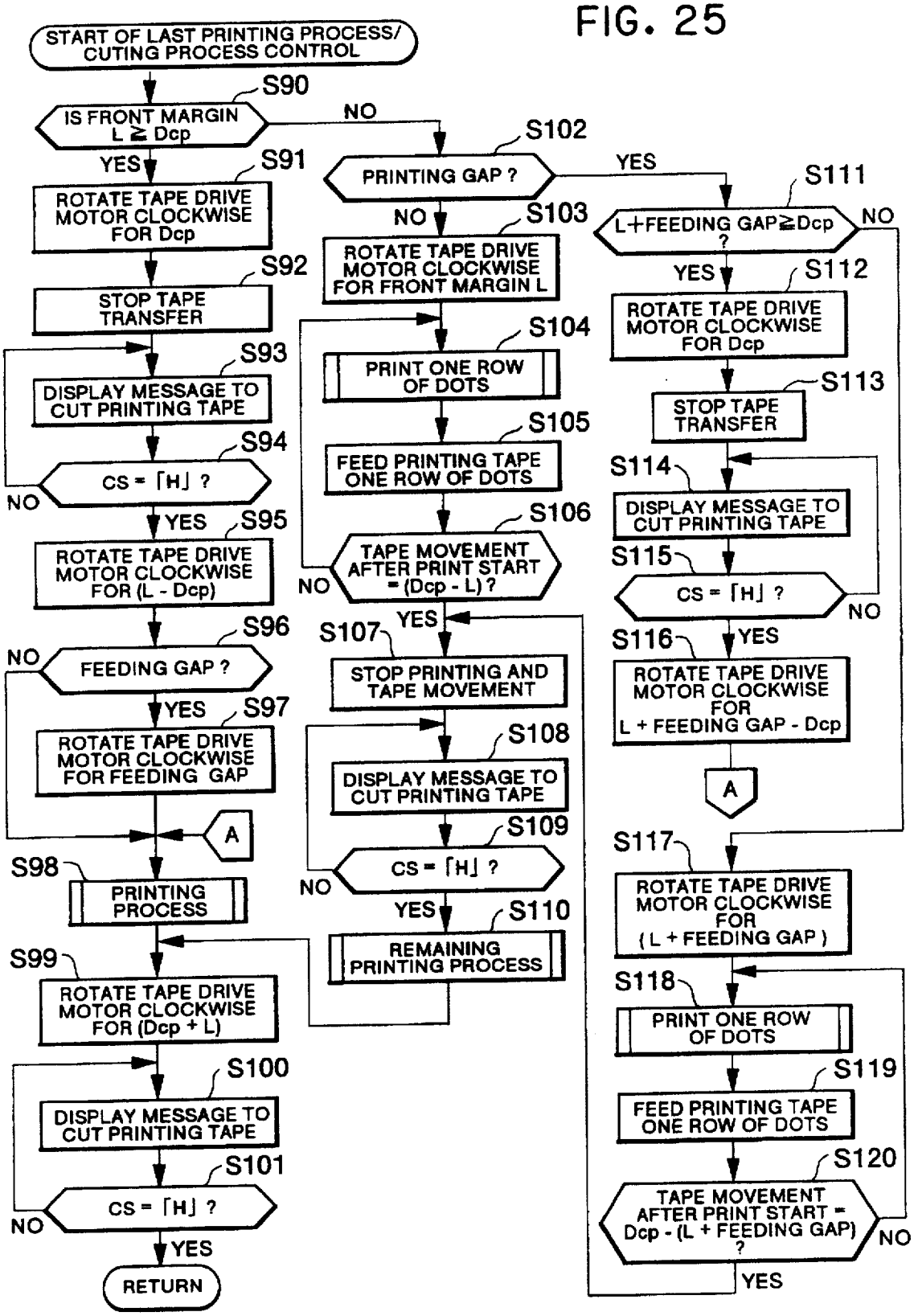
FIG. 25 is a flowchart representing a final color printing process and a cutting process control.

Next, in the multi-color printing control, the color number N is decremented by one (S21). If the color number is not "1," or not the final printing (S17:NO), steps S18 through S21 are repeated. If the color number N becomes "1," or the final printing (S17:YES), the final color printing process and cutting process control (S22) will be executed, as shown in FIG. 25.

This control is separated into four cases. In Case 1, the front margin L is greater than the distance Dcp between cutting and printing positions. In Case 2, the front margin L is smaller than the Dcp, and no idle feeding is provided. In Case 3, the front margin L is smaller than the Dcp, and idle feeding is provided, and further, the total length of the front margin L and the idle feeding is equal to or greater than the distance Dcp between the printing position and the cutting position. In Case 4, the front margin L is smaller than the Dcp, and idle feeding is provided, and further, the total length of the front margin L and the idle feeding is smaller than the distance Dcp between the printing position and the cutting position.

First, Case 1 will be described. If the front margin L is greater than the Dcp (S90:YES), the printing tape 22 is moved only the distance Dcp in the feeding direction T by the tape drive motor 44 being driven in the clockwise direction (S91). Then, the drive of the tape drive motor 44 is stopped, stopping the tape movement (S92). Next, the tape drive motor 44 is rotated a little in the rewinding direction. When the end portion of the cut prevention lever 84 is removed from beneath the cutting lever 82, making the cutting operation possible, as shown in FIG. 15, a message prompting the user to cut the printing tape 22 is displayed in the display 5 (S93). Then, when the printing tape 22 is cut and the cutting detection signal CS becomes the "H" level, signifying the tape cutting has been detected (S94:YES), the printing tape 22 is moved in the feeding direction T by the remaining distance of the front margin L (front margin L−Dcp) (S95).

If the print start position of the last printing color is upstream from the print start point of origin of the label printing in the feeding direction T, and there exists an idle feeding (S96:YES), the tape drive motor 44 is driven in the clockwise direction, moving the printing tape 22 in the feeding direction T by the length of the idle feeding (S97). Then, the characters, symbols, and the like, based on the dot image data read similar to S63 described earlier, are printed in the final printing color (S98).

Next, in order to provide the rear margin L behind the printed character array, the tape drive motor 44 is driven in the clockwise direction, moving the printing tape 22 in the feeding direction T only by the distance Dcp plus the rear margin L (S99). Then, the tape drive motor 44 is rotated slightly in the rewinding direction. When the end portion of the cut prevention lever 84 is removed from beneath the cutting lever 82, making the cutting operation possible, a message prompting the user to cut the printing tape 22 is displayed in the display 5 (S100). Then, when the printing tape 22 is cut and the cutting detection signal CS becomes the "H" level, signifying the tape cutting has been detected (S101:YES), control is returned to S10 of the multi-color printing control.

Next, Case 2 will be described. When the front margin L is less than the distance Dcp and no idle feeding exists (S90 and S102:NO), the tape drive motor 44 is driven in the clockwise direction, moving the printing tape 22 in the feeding direction T by the distance of the front margin L (S103). Then, the final printing process and cutting of the printing tape 22 is performed according to the steps beginning at S104.

More specifically, one row of the dot pattern data is read from the printing data buffer 125 and printing is performed with the one row of the dot pattern (S104). The tape drive motor 44 is driven in the clockwise direction, moving the printing tape 22 only by the short distance corresponding to the one row of dots (S105). If the amount of tape movement after the final printing has begun is less than the distance of the front margin L subtracted from the distance Dcp, that is, if the top position of the front margin has not yet reached the cutting position (C position) (S106:NO), then steps S104 through S106 are repeated.

When the top position of the front margin L has reached the cutting position (S106:YES), the printing and tape movement are stopped (S107). Then, the tape drive motor 44 is rotated slightly in the rewinding direction. When the end portion of the cut prevention lever 84 is removed from beneath the cutting lever 82, making the cutting operation possible, a message prompting the user to cut the printing tape 22 is displayed in the display 5 (S108). Then, when the cutting button 85 is pressed, the printing tape 22 is cut, and the cutting detection signal CS becomes the "H" level, signifying the tape cutting has been detected (S109:YES), printing of the remaining dot pattern data to be printed is carried out (S110). The rear margin L is provided according to steps S99 through S101, and the tape is cut, and control is returned to S10.

Next, Case 3 will be described. When the front margin L is smaller than the distance Dcp between the printing position and the cutting position, and an idle feeding exists and the total length of this idle feeding and to the front margin L is greater than the distance Dcp (S90:No, S102 and S111:YES), the tape is moved as in the previously described steps S91 through S94, and the tape is cut (S112 through S115). Further, the printing tape 22 is moved in the feeding direction T by the distance (front margin L+idle feeding−Dcp) (S116). Then, the steps beginning from S98 are executed, so that printing in the final color is performed, and the rear margin L is provided, and the tape is cut. Control is then returned to S10.

Finally, Case 4 will be described. When the front margin L is smaller than the distance Dcp, and an feeding exists and the value of this idle feeding added to the front margin L is less than the distance Dcp (S90:No, S102:YES, S111:NO), the printing tape 22 is moved in the feeding direction T by the distance of the total length of the front margin L and the idle feeding (S117). Then one row of the dot pattern data is read from the printing data buffer 125 and printing is performed (S118). The tape drive motor 44 is driven in the clockwise direction, moving the printing tape 22 only by the short distance corresponding to the one row of dots (S119).

When the amount of tape movement after the final printing has begun is less than the difference between the distance Dcp and the total length of the front margin L and the idle feeding length, that is the top position of the front margin L has not yet reached the cutting position, (S120:NO), then steps S118 through S120 are repeated. When the top position of the front margin L has reached the cutting position (S120:YES), the steps beginning from S107 are executed. Both the front margin L and the rear margin L are provided, and the tape is cut. Control is then returned to S10.

Figure 29:
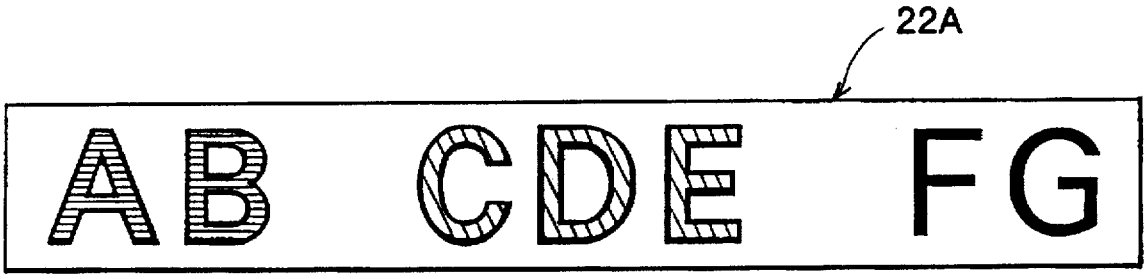
FIG. 29 is a plan view showing the tape-shaped label printed in three colors.

As in the example of the input text "AB CDE FG" shown in FIG. 29, a label was obtained with the front and rear margins L provided, the character array "AB" printed in the printing color 1 or red, the character array "CDE" printed in the printing color 2 or green, and the character array "FG" printed in the printing color 3 or black.

Next, the operations of the multi-color printing process will be described.

When order setting is selected after input of text, the print color number setting process of FIG. 18 for setting the number N of print colors is executed. Also, the process of FIG. 19 for setting the target range to be printed for each print color in order is executed. When printing is started, the print start operation is executed and whether or not a ribbon cassette 30 is mounted is determined based on the ribbon detection signal RS from the ribbon detection switch group 103. If no ribbon cassette 30 is mounted, this is indicated by an error message displayed on the display 5 so that the user will open the cassette cover 3, mount the ribbon cassette 30, and close the cassette cover 3.

When the ribbon cassette 30 is detected as being mounted, the character array stored appended to the order data that matches the leading printing color C is retrieved from the text memory 121. The thermal head 12 and the tape drive motor 44 are controlled to be driven and a print process is performed. Further, each time printing is performed in the second and further colors, a start print position process is executed. Then the ribbon cassette 30 is exchanged and a printing process is performed on the character array appended to the order data that matches the leading printing color C in the same manner as described above.

In this way, the order of print colors is set to the characters and symbols of the inputted text so that a user can perform color printing using ribbon cassettes with newly added ribbon colors by exchanging a ribbon cassette 30 having a desired ribbon color according to messages displayed on the display 5.

On the other hand, when color setting is selected, the print color sequence setting process for setting the color number N of colors and the color sequence for the print colors is executed as described with reference to FIG. 18. Then, the process for setting the printing target range for each print color is executed for printing in a plurality of colors as described with reference to FIG. 19. When printing is started, the print start process of FIG. 21 is executed and the ribbon color R of the mounted ribbon cassette 30 is detected based on the ribbon detection signal RS from the ribbon detection switch group 103. The ribbon color R is compared with the top print color C. When these two colors do not match, an error message informing the user of the mismatch is displayed on the display 5 so that the user will open the cassette cover 3, replace the ribbon cassette 30, and close the cassette cover 3.

When the result of the comparison between the ribbon color R and the first ribbon color C indicates that the colors match, the character array stored appended to the data of the print color C is retrieved from the text memory 121 and the thermal head 12 and the tape drive motor 44 are controlled to be driven so that the print process is performed. Further, each time printing is performed in one of a second or further print colors, the process of FIG. 24 for aligning the print start position is performed. The ribbon color R of the mounted ribbon cassette 30 is compared with the next print color C. When these two colors do not match, an error message informing the user of the mismatch is displayed on the display 5. Alternatively, when these colors match, in the same manner as described above, a print process is performed on the character train array appended with data of the print color C.

In summary, after inputting text, a print color sequence setting process is executed. First, because a message "What is the number of print colors" is displayed on a display 5, a print number setting routine for setting a number N of colors is performed by operating a number key and the set number N of colors is stored in a color number memory 122 (S25). Next, because a message "1 order setting 2 color setting" is displayed on the display 5, a setting selection routine is executed for selecting, by manipulating either a 1 or 2 number key, whether color setting or order setting is to be performed (S26). Here, setting is performed according to the selected one of the order setting and the color setting for multi-color printing of characters and symbols of inputted text.

As described above, settings for multi-color printing can be selected in two manners: order setting or color setting. By selecting color setting, print color for each character and symbol of the text is set. Therefore, correspondence between characters and symbols of the text and print color becomes obvious so that the user can easily recognize which colors he or she set so that the setting operation for existing colors can be easily performed. By selecting order setting, multi-color printing can be performed by using ribbon cassettes with newly added ribbon colors. The setting method can be selected according to the objective of the user.

As described above, the detection hole group 36 is provided in a horizontal wall portion 31*d* of the ribbon cassette 30. A maximum of six detection holes 36*a* are combined according to a ribbon color in the ribbon cassette 30. The ribbon detection switch group 103 includes the first through sixth detection switches provided to the cassette housing portion side of the label printing device 1. Which of the plurality of different colors of ribbon cassette 30 is mounted in the label printing device 1 is detected by the ribbon detection switch group 103. Therefore, the ribbon color of the mounted ribbon cassette 30 can be accurately detected.

Therefore, when color setting is selected, when a ribbon cassette having a ribbon color different from the preset print color sequence is mounted in the tape printer, the wrong colored ribbon color will not be printed. Only when the next print color to be printed matches the ribbon color will printing be performed in that print color. There is no need to take precautionary measure to insure printing is performed in the correct print color sequence during multi-color printing is performed. Each character and symbol of the inputted text can be printed accurately in its preset print color.

When the print color is set to each character and symbol of the text, correspondence between each character and symbol of the text and print color becomes obvious and clear. Each character and symbol of the text can be accurately printed in the set print color. In this case, when the next color to be printed does not match the ribbon color, an error message is displayed on the display 5 so that the user can easily recognize when the wrong ribbon cassette 30 is mounted by reading the error message on the display 5.

In the present embodiment, characters and symbols not set with a print color sequence or a print color are set with the last print order or print color. Therefore, the number of times settings that must be performed is reduced and the setting operations can be easily and quickly performed.

While the invention has been described in detail with reference to specific embodiments thereof, it would be apparent to those skilled in the art that various changes and modifications may be made therein without departing from the spirit of the invention, the scope of which is defined by the attached claims.

For example, the tape-shaped label printing device can be designed to set only the order in which characters and symbols of inputted text are printed. In this case, some components and processes related to setting color sequence can be dispensed with so that the tape-shaped label printing device has a simpler configuration. Such a configuration will still allow a user to print using newly added ink ribbons not available when the tape-shaped label printing device was first produced.

Figure 30:
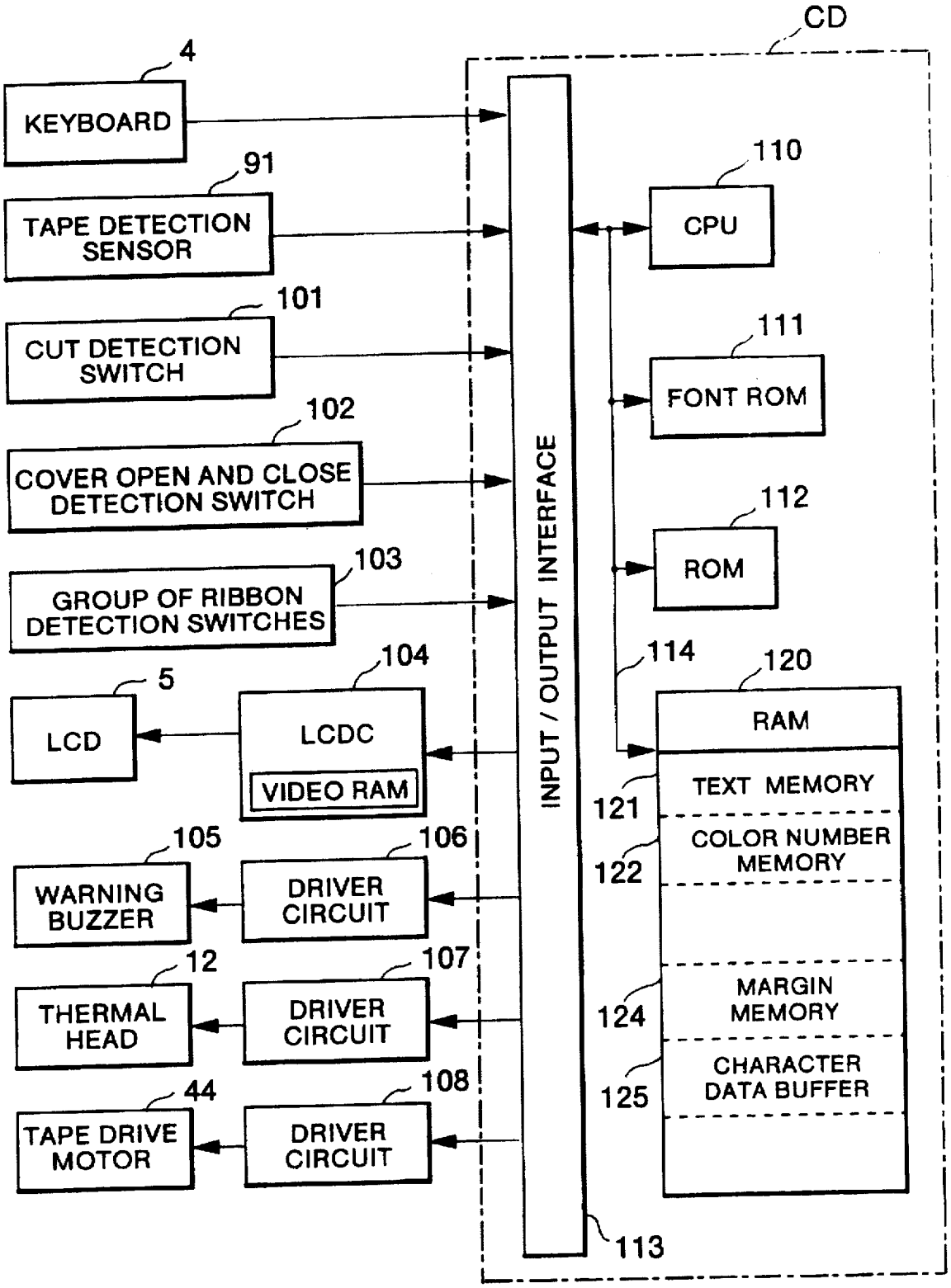
FIG. 30 is a block diagram showing a control system of a tape-shaped label printing device according to a second embodiment of the present invention.
Figure 31:
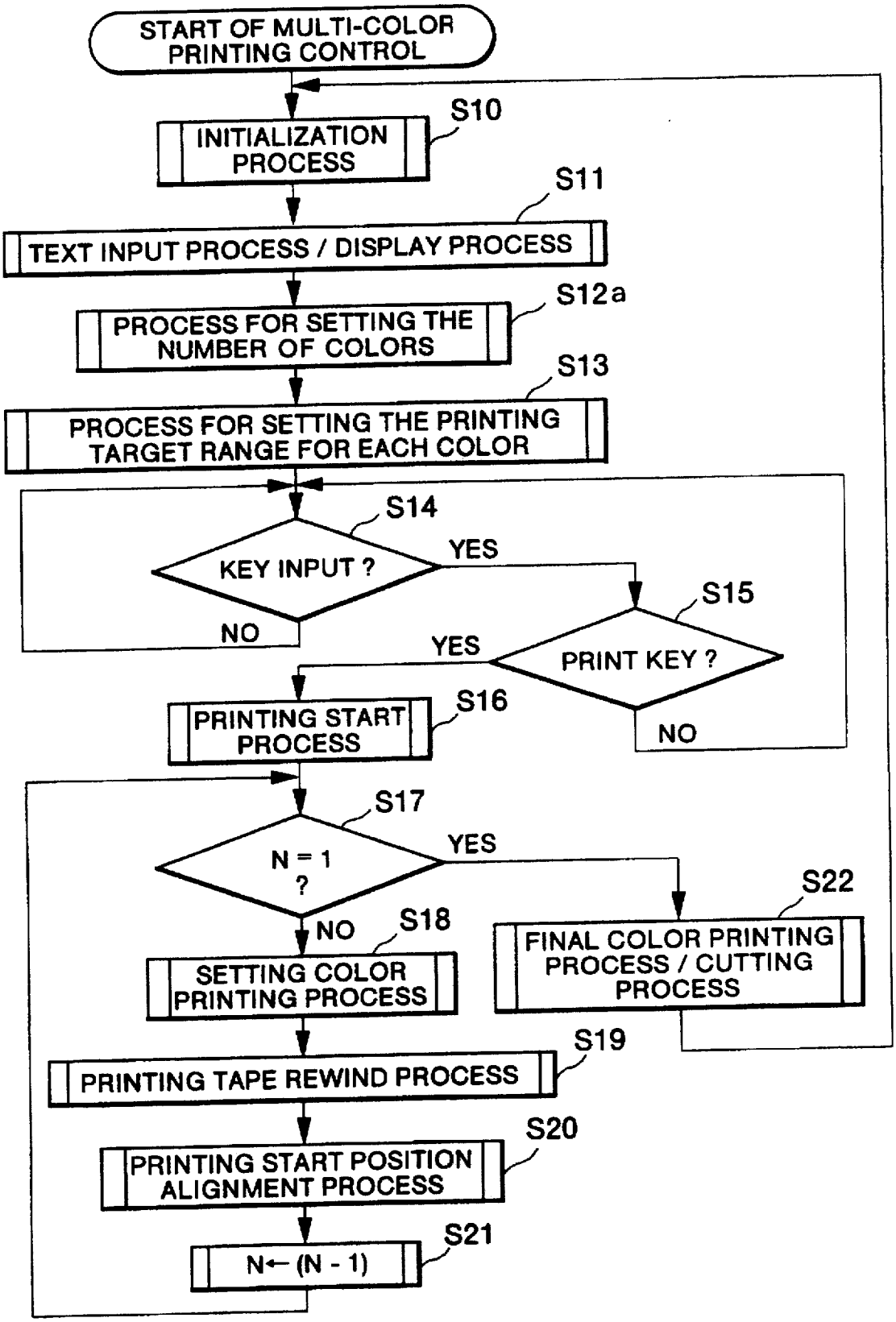
FIG. 31 is a flowchart representing a multi-color printing routine according to the second embodiment.
Figure 32:
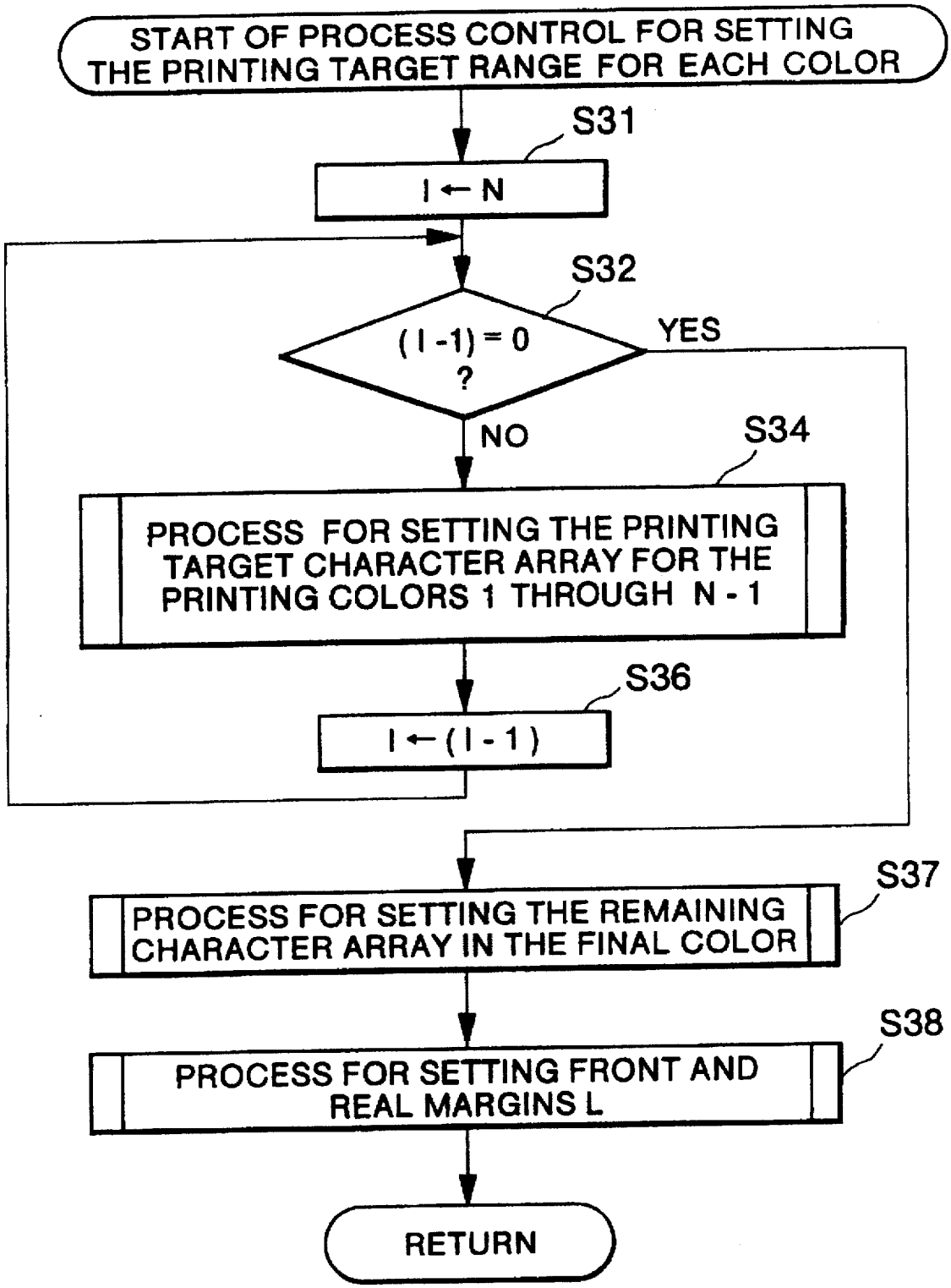
FIG. 32 is a flowchart representing a process control for setting printing target range for each color according to the second embodiment.

For example, as shown in FIG. 30, the color sequence memory 123 is not provided to the RAM 120. As shown in FIG. 31, after S11, the process in S25 of FIG. 18 for setting the number of colors is performed in S12a. Other steps from the process for setting printing color sequence represented by the flowchart of FIG. 18 are eliminated. Also, as shown in FIG. 32, S33 and S35 are eliminated from the process control for setting printing the target range for each color. Therefore, when the color number count value I decremented by one does not equal zero (S32:NO), then the program proceeds directly to S34.

Figure 20:
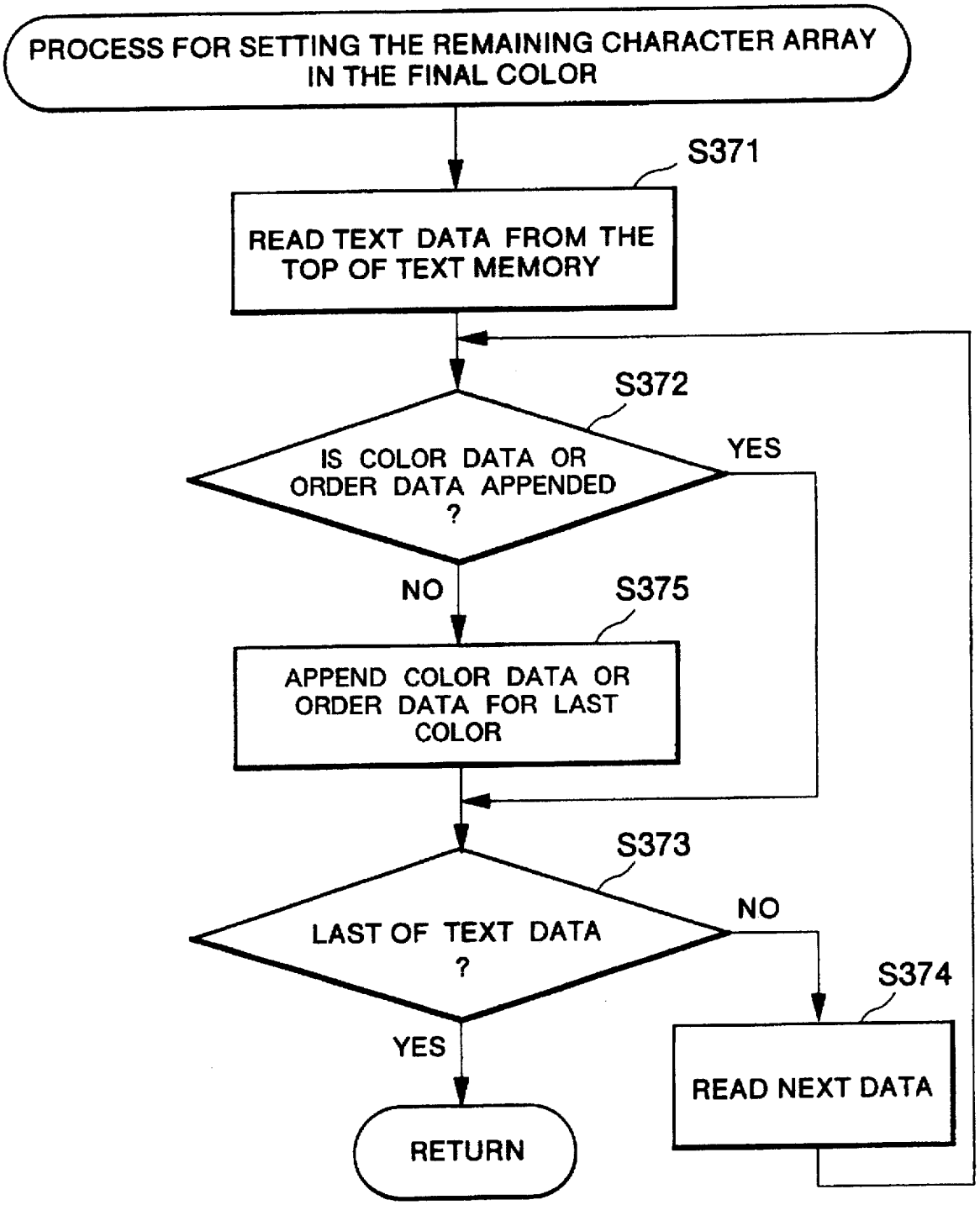
FIG. 20 is a flowchart representing a process control for setting the final printing color with respect to the remaining character array.

Although not shown in the drawings, it can be understood that the process for setting the remaining character array in the final color represented by the flowchart of FIG. 20 is only performed with regard to order data and not for color data. Because the order of those characters and symbols of the text not yet set with an order is automatically set, the number of order settings can be reduced. Operations for setting order of printing color can be easily and quickly performed.

Figure 33:
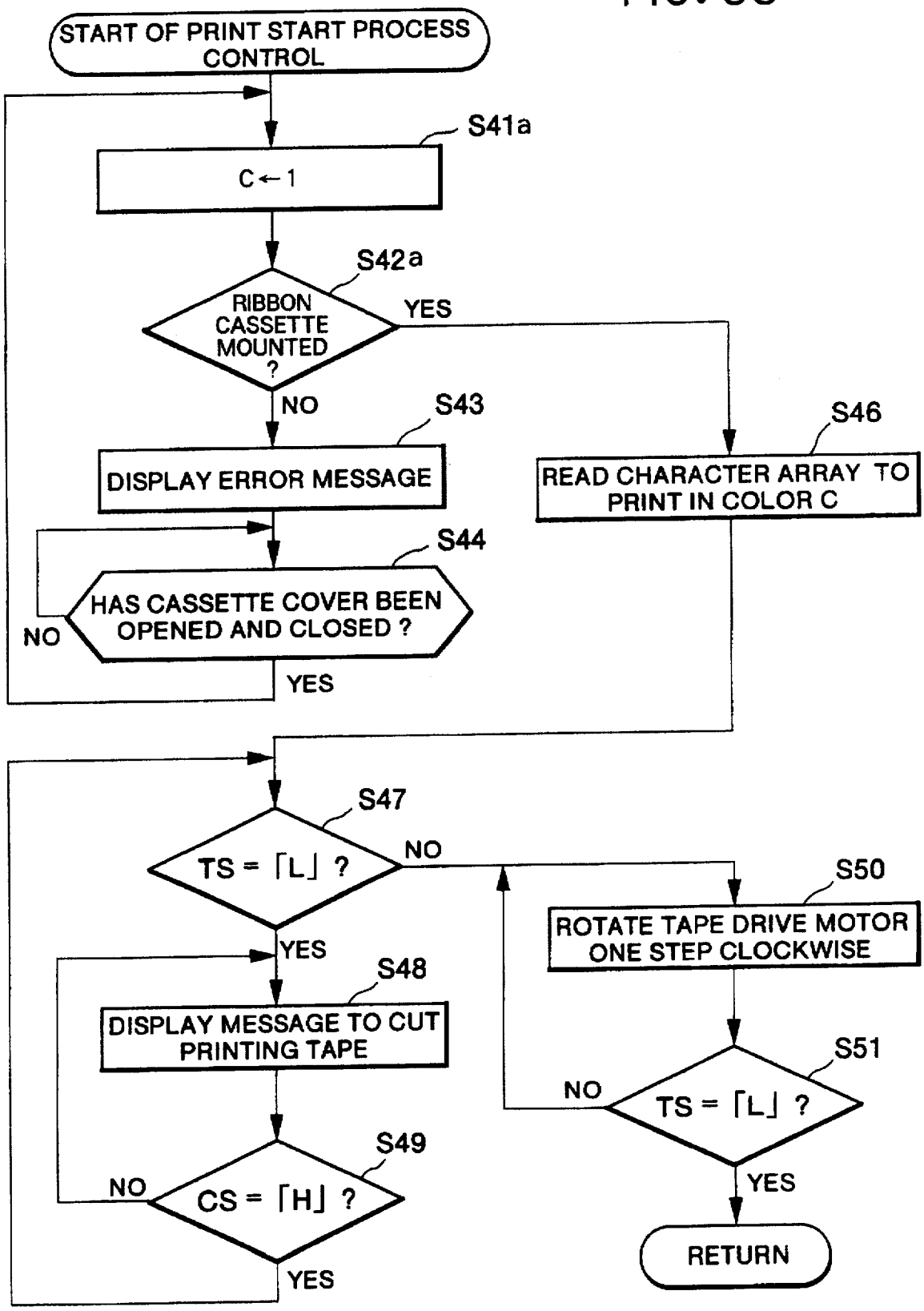
FIG. 33 is a flowchart representing a print start process control according to the second embodiment.
Figure 34:
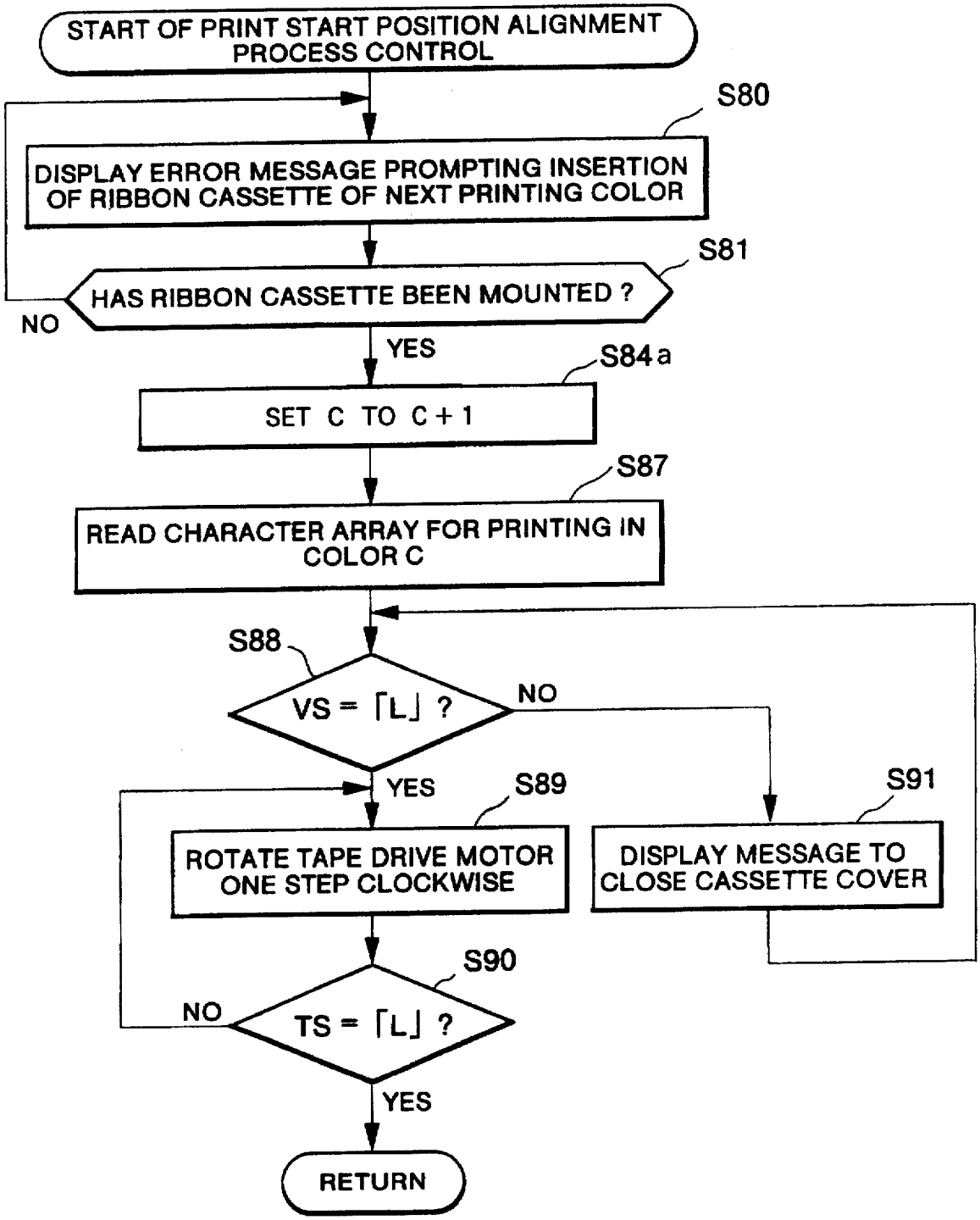
FIG. 34 is a flowchart representing a print start position alignment process control according to the second embodiment.

As shown in FIG. 33, S39, S40, S41, S42, and S45 are eliminated from the print start process control. Instead, after start of this process, the leading printing color C is set to one in S41a and then whether or not a ribbon cassette 30 is mounted is determined in S42a. If so (S42a:Yes), then the process proceeds to S46. If not (S42a:No), then the process proceeds to S43. As shown in FIG. 34, S82, S83, S84, S85, and S86 are eliminated. Instead, after a positive determination in S81 (S81:Yes), the leading printing color C is incremented by one in S84a. Then the process proceeds directly to S87.

Also, it should be noted that the present invention can be configured so that each time a character and symbol of text data is inputted, the color data can be set. Also, the present invention can be configured so that the setting range for characters and symbols of the printing target of inputted text data can be indicated by moving the cursor and setting the values. Further, it is obvious that the present invention can be applied to various tape-shaped label printing devices 1 for printing in multiple colors by exchanging in sequence a plurality of ribbon cassettes 30 with differing ribbon colors.

What is claimed is:

1. A tape-shaped label printing device for use with a plurality of freely detachable ribbon cassettes each housing a different colored ink ribbon, the label printing device comprising:

input means for inputting text, such as characters and symbols, and for inputting a variety of commands;

data memory means for storing inputted text data;

print means including a print head for printing on a print tape in colors of the ink ribbons in the ribbon cassettes;

order setting means for setting a printing order for printing text stored in the data memory means in a first plurality of colors using corresponding ones of the different colored ink ribbons; and print control means for driving the print means to print in the print order set by the order setting means.

2. A tape-shaped label printing device as claimed in claim 1, further comprising:

color setting means for setting, to text stored in the data memory means, printing target ranges for printing in a second plurality of colors using corresponding ones of the different colored ink ribbons; and selection means for selecting one of the color setting means and the order setting means; and wherein:

the print control means controls the print means to print on the tape according to settings of a selected one of the color setting means and the order setting means selected by the selection means.

3. A tape-shaped label printing device as claimed in claim 2, further comprising:

ribbon color detection means for detecting a color of the ink ribbon housed in the ribbon cassette presently used in label printing device;

comparison means for, when printing is to be performed according to settings of the color setting means, comparing a print color, which the print control means is to control the print means to print, with the color of the ink ribbon detected by the ribbon color detection means; and print prevention means for preventing printing when the comparison means determines that the print color and the color of the ink ribbon do not match.

4. A tape-shaped label printing device as claimed in claim 3, further comprising a display means controlled by the print control means to display a message prompting replacement of a mounted ribbon cassette each time printing of a target range is completed.

5. A tape-shaped label printing device as claimed in claim 4, wherein the print control means controls the display means to display a message warning of a mismatch when the comparison means determines that the print color and the color of the ink ribbon do not match.

6. A tape-shaped label printing device as claimed in claim 3, wherein the ribbon color detection means uses the mounted ribbon cassette to detect the color of the ribbon housed therein.

7. A tape-shaped label printing device as claimed in claim 6, wherein the ribbon color detection means includes a plurality of detectors confronting an identifying portion of a ribbon cassette used in the label printing device, each detector having a switch urged to protrude from its detector toward the identifying portion of the ribbon cassette and through any holes formed in the identifying portion to identify the color of ink ribbon housed in the ribbon cassette.

8. A tape-shaped label printing device as claimed in claim 2, wherein the first plurality of colors includes more colors than second plurality of colors.

9. A tape-shaped label printing device as claimed in claim 2, wherein the first plurality of colors is the same as the second plurality of colors.

10. A tape-shaped label printing device as claimed in claim 2, wherein the order setting means includes:

first printing target setting means for setting order of printing targets of the text other than a last order; and second printing target setting means for automatically setting the last order to text not set with an order by the first printing target setting means.

11. A tape-shaped label printing device as claimed in claim 2, wherein the color setting means includes:

third printing target setting means for setting printing targets to the text for each print color other than a lastly set print color; and fourth printing target setting means for automatically setting text not set by the first printing target setting means as a printing target of the lastly set print color.

12. A tape-shaped label printing device as claimed in claim 2, further comprising a display means controlled by the print control means to display a message prompting replacement of a mounted ribbon cassette each time printing of a target range is completed.

13. A tape-shaped label printing device as claimed in claim 1, wherein the order setting means includes:

first printing target setting means for setting order of printing targets of the text other than a last order; and second printing target setting means for automatically setting the last order to text not set with an order by the first printing target setting means.

14. A tape-shaped label printing device as claimed in claim 13, further comprising:

an order number setting means for setting a number of orders;

a counter for counting number of orders set by the first printing target setting means; and order number comparison for comparing the number of orders set by the order number setting means and the number of the counter to determine the last order.

15. A tape-shaped label printing device as claimed in claim 1, wherein the order setting means automatically sets text not set with a previous print color as a printing target of a lastly set print color.

16. A tape-shaped label printing device as claimed in claim 1, further comprising a display means controlled by the print control means to display a message prompting replacement of a mounted ribbon cassette each time printing of a target range is completed.

17. A tape-shaped label printing device as claimed in claim 1, wherein the order setting means sets the printing order for printing the text by dividing the text into portions corresponding to the first plurality of colors.

18. A tape-shaped label printing device as claimed in claim 1, wherein the print control means controls the print means to rewind the print tape a predetermined distance after controlling the print means to print, in a first one of the first plurality of colors, a first portion of the text that is first in the printing order.

19. A tape-shaped label printing device as claimed in claim 1, wherein the print control means controls the print means to print the text in the printing order by printing one of consecutive portions of the text each time a ribbon cassette of the first plurality of colors is mounted in the print means.

* * * * *